US008646136B2

(12) United States Patent
Young et al.

(10) Patent No.: US 8,646,136 B2
(45) Date of Patent: Feb. 11, 2014

(54) ASSEMBLIES, SYSTEMS, AND RELATED METHODS EMPLOYING INTERLOCKING COMPONENTS TO PROVIDE AT LEAST A PORTION OF AN ENCASEMENT, PARTICULARLY FOR BEDDING AND SEATING APPLICATIONS

(75) Inventors: Julian Thomas Young, Zebulon, NC (US); Timothy Michael Witherell, Gastonia, NC (US); Christopher Dean Page, Nashville, NC (US)

(73) Assignee: Nomaco Inc., Zebulon, NC (US)

( * ) Notice: Subject to any disclaimer, the term of this patent is extended or adjusted under 35 U.S.C. 154(b) by 130 days.

(21) Appl. No.: 12/870,316

(22) Filed: Aug. 27, 2010

(65) Prior Publication Data

US 2011/0049327 A1 Mar. 3, 2011

Related U.S. Application Data

(60) Provisional application No. 61/237,498, filed on Aug. 27, 2009.

(51) Int. Cl.
*A47C 23/04* (2006.01)

(52) U.S. Cl.
USPC ..... 5/717; 5/201; 248/346.3; 297/440.13

(58) Field of Classification Search
USPC ..... 248/621, 633, 346.3; 297/440.1, 297/440.12, 440.13, 440.22; 5/177, 201, 5/285, 300, 678, 680, 701, 705, 716, 717, 5/718, 719, 721
See application file for complete search history.

(56) References Cited

U.S. PATENT DOCUMENTS

| | | | | |
|---|---|---|---|---|
| 554,580 | A | 2/1896 | Conkwright | |
| 676,573 | A | 6/1901 | Bowers | |
| 1,371,362 | A | 3/1921 | Giese | |
| 1,429,776 | A | 9/1922 | Robinson | |
| 1,979,566 | A * | 11/1934 | Morse | 5/285 |

(Continued)

FOREIGN PATENT DOCUMENTS

| | | |
|---|---|---|
| EP | 1674003 B1 | 5/2013 |
| GB | 2095545 A | 10/1982 |

(Continued)

OTHER PUBLICATIONS

"C-Clip 5.0 inch," Product Specifications, Nomaco, Inc., Jul. 9, 2009, 3 pages.

(Continued)

*Primary Examiner* — Bradley Duckworth
(74) *Attorney, Agent, or Firm* — Withrow & Terranova, PLLC

(57) ABSTRACT

Encasement assemblies, systems, and related methods employing interlocking support components to provide at least a portion of an encasement for bedding or seating are disclosed. The assembly may include a base having flip-up support member(s). The base may include elongated channel (s) disposed therein having a first geometry and a portion of the elongated channel(s) may also be disposed in the flip-up support member(s). The assembly may also include elongated support member(s) each having a first side and a second side. The first side may contain a rail and the second side may contain a second rail. Each rail and second rail may be interlocked with the elongated channel(s), such that the elongated support member(s) are attached to the base and provide at least a portion of the encasement.

31 Claims, 20 Drawing Sheets

(56) References Cited

U.S. PATENT DOCUMENTS

| | | | |
|---|---|---|---|
| 1,986,255 | A | 1/1935 | Durfey et al. |
| D105,428 | S | 7/1937 | Bahr |
| D136,717 | S | 11/1943 | Moore et al. |
| 2,337,525 | A | 12/1943 | Peik |
| 2,539,058 | A | 1/1951 | Burns |
| 2,569,021 | A | 9/1951 | Rozanski |
| 2,615,577 | A | 10/1952 | Bartleman |
| 2,630,145 | A | 3/1953 | Stevens |
| 2,826,769 | A | 3/1958 | Drews |
| 2,940,089 | A | 6/1960 | Koenigsberg |
| 2,978,714 | A | 4/1961 | Bechik |
| 3,046,574 | A | 7/1962 | Erenberg et al. |
| 3,082,438 | A | 3/1963 | Nachman, Jr. |
| 3,263,533 | A | 8/1966 | Carlson |
| 3,293,671 | A | 12/1966 | Griffin |
| 3,318,224 | A | 5/1967 | Bohanon |
| 3,749,301 | A | 7/1973 | Peckar |
| 3,775,526 | A | 11/1973 | Gilmore |
| 3,822,426 | A | 7/1974 | Mistarz |
| 3,848,283 | A | 11/1974 | Ikeda |
| 3,894,706 | A | 7/1975 | Mizusawa |
| D240,681 | S | 7/1976 | Granatelli |
| D241,314 | S | 9/1976 | Hug |
| D245,747 | S | 9/1977 | Ikeda |
| 4,121,005 | A | 10/1978 | Roberts |
| 4,181,992 | A | 1/1980 | Blake |
| 4,194,255 | A | 3/1980 | Poppe |
| 4,207,636 | A | 6/1980 | Ceriani |
| 4,275,473 | A | 6/1981 | Poirier |
| D273,659 | S | 5/1984 | Sakaguchi |
| 4,451,946 | A | 6/1984 | Stumpf |
| 4,821,988 | A | 4/1989 | Jimenez |
| 4,907,309 | A | 3/1990 | Breckle |
| 4,915,662 | A | 4/1990 | Kent |
| D307,688 | S | 5/1990 | Schaefer |
| D307,690 | S | 5/1990 | Raburn |
| D310,313 | S | 9/1990 | Afeyan |
| 4,998,310 | A | 3/1991 | Olson |
| 5,005,793 | A | 4/1991 | Shillington |
| 5,039,366 | A | 8/1991 | Strattman |
| 5,040,255 | A | 8/1991 | Barber, Jr. |
| 5,048,167 | A | 9/1991 | Heffley et al. |
| D322,907 | S | 1/1992 | Raburn |
| 5,115,524 | A | 5/1992 | Antosko |
| 5,133,116 | A | 7/1992 | Wagner et al. |
| 5,195,197 | A | 3/1993 | Gutierrez et al. |
| 5,231,718 | A | 8/1993 | Blaha et al. |
| 5,239,715 | A | 8/1993 | Wagner |
| 5,398,820 | A | 3/1995 | Kiss |
| 5,415,370 | A | 5/1995 | Valiulis |
| D363,016 | S | 10/1995 | Sipprelle, III et al. |
| 5,456,437 | A | 10/1995 | Chander et al. |
| 5,462,212 | A | 10/1995 | Hertel, Jr. |
| 5,467,488 | A | 11/1995 | Wagner |
| 5,469,590 | A | 11/1995 | Simon |
| 5,491,852 | A | 2/1996 | Maucher |
| 5,537,699 | A | 7/1996 | Bonaddio et al. |
| D376,309 | S | 12/1996 | Takai |
| 5,642,557 | A | 7/1997 | Clews |
| 5,687,439 | A | 11/1997 | Wagner |
| 5,705,252 | A | 1/1998 | Lea et al. |
| 5,724,686 | A | 3/1998 | Neal |
| 5,743,497 | A | 4/1998 | Michael |
| 5,756,022 | A | 5/1998 | Siegel et al. |
| 5,787,532 | A | 8/1998 | Langer et al. |
| 5,792,309 | A | 8/1998 | Eto |
| 5,815,865 | A | 10/1998 | Washburn et al. |
| 5,861,205 | A | 1/1999 | Murata et al. |
| D406,051 | S | 2/1999 | Ross |
| 5,924,682 | A | 7/1999 | Bullard |
| D413,035 | S | 8/1999 | Weterrings et al. |
| 5,987,678 | A | 11/1999 | Ayers |
| D417,612 | S | 12/1999 | Jones |
| 6,003,179 | A | 12/1999 | Farley |
| D418,354 | S | 1/2000 | O'Rourke |
| 6,023,803 | A | 2/2000 | Barman |
| 6,026,525 | A | 2/2000 | Davis |
| 6,109,569 | A | 8/2000 | Sakaida |
| 6,122,787 | A | 9/2000 | Kao |
| D432,404 | S | 10/2000 | Garfinkle |
| 6,154,908 | A | 12/2000 | Wells |
| 6,158,071 | A | 12/2000 | Wells |
| D436,772 | S | 1/2001 | Soderstrom |
| 6,202,238 | B1 | 3/2001 | Mossbeck et al. |
| 6,243,894 | B1 | 6/2001 | Kosumsuppamala et al. |
| 6,260,331 | B1 | 7/2001 | Stumpf |
| 6,263,533 | B1 | 7/2001 | Dimitry et al. |
| 6,286,166 | B1 | 9/2001 | Henley et al. |
| 6,295,676 | B1 | 10/2001 | Warner |
| 6,306,235 | B1 | 10/2001 | Henderson |
| 6,315,275 | B1 | 11/2001 | Zysman |
| D454,740 | S | 3/2002 | Baggott |
| 6,353,952 | B1 | 3/2002 | Wells |
| D456,197 | S | 4/2002 | McClure et al. |
| 6,370,717 | B1 | 4/2002 | Kao |
| 6,398,199 | B1 | 6/2002 | Barber |
| D467,117 | S | 12/2002 | Guy |
| 6,488,031 | B1 | 12/2002 | Sells, II |
| 6,496,993 | B2 | 12/2002 | Allen et al. |
| 6,523,812 | B1 | 2/2003 | Spinks et al. |
| 6,537,405 | B1 | 3/2003 | Henderson et al. |
| 6,568,014 | B1 | 5/2003 | Sabalaskey et al. |
| 6,574,814 | B2 | 6/2003 | Collard et al. |
| 6,612,525 | B2 | 9/2003 | Bagdi |
| 6,658,682 | B1 | 12/2003 | Wells |
| 6,684,434 | B2 | 2/2004 | Ellis et al. |
| 6,721,981 | B1 | 4/2004 | Greenhalgh et al. |
| 6,772,463 | B2 | 8/2004 | Gladney et al. |
| 6,804,847 | B2 | 10/2004 | Grothaus |
| 6,813,791 | B2 | 11/2004 | Mossbeck et al. |
| 6,826,796 | B1 | 12/2004 | Mossbeck |
| 6,832,397 | B2 | 12/2004 | Gaboury et al. |
| 6,862,763 | B2 | 3/2005 | Mossbeck et al. |
| 6,883,196 | B2 | 4/2005 | Barber |
| 6,898,813 | B2 | 5/2005 | Grothaus |
| D506,385 | S | 6/2005 | Brown |
| 6,954,957 | B2 | 10/2005 | Metzger et al. |
| 6,966,090 | B2 | 11/2005 | McClintock et al. |
| 6,966,091 | B2 | 11/2005 | Barber |
| 7,017,205 | B2 * | 3/2006 | Gladney ..... 5/400 |
| 7,028,352 | B2 | 4/2006 | Kramer et al. |
| 7,036,173 | B2 | 5/2006 | Gladney |
| 7,044,557 | B2 * | 5/2006 | Wieland ..... 297/440.1 |
| 7,082,635 | B2 | 8/2006 | Barman et al. |
| 7,093,858 | B1 | 8/2006 | Russell |
| 7,127,765 | B2 | 10/2006 | Ruiz |
| 7,165,282 | B2 | 1/2007 | Watson |
| D537,331 | S | 2/2007 | Hill |
| 7,178,187 | B2 | 2/2007 | Barman et al. |
| 7,185,379 | B2 | 3/2007 | Barman |
| 7,185,770 | B1 | 3/2007 | Roten |
| 7,194,777 | B2 | 3/2007 | Edling et al. |
| 7,210,181 | B1 | 5/2007 | Price |
| 7,251,847 | B2 | 8/2007 | Wells |
| D569,160 | S | 5/2008 | Mossbeck |
| D581,715 | S | 12/2008 | Scheuch |
| D583,607 | S | 12/2008 | Hanson et al. |
| 7,546,648 | B2 | 6/2009 | Steffes |
| 7,597,296 | B2 | 10/2009 | Conway |
| 7,608,782 | B2 | 10/2009 | Hill |
| 7,644,461 | B2 | 1/2010 | Lee |
| D612,188 | S | 3/2010 | Yiannaki |
| 7,685,664 | B2 | 3/2010 | Stolpmann et al. |
| 7,805,790 | B2 | 10/2010 | DeMoss |
| 7,841,031 | B2 | 11/2010 | Rawls-Meehan |
| 7,845,035 | B2 | 12/2010 | Letton et al. |
| 7,845,036 | B2 | 12/2010 | Rinchetti |
| 7,865,988 | B2 | 1/2011 | Koughan et al. |
| 7,870,626 | B2 | 1/2011 | Antinori |
| D636,622 | S | 4/2011 | Quinter et al. |
| D640,535 | S | 6/2011 | Austro |
| D642,413 | S | 8/2011 | Rinehart |
| D642,847 | S | 8/2011 | Rinehart |
| 7,992,712 | B2 | 8/2011 | Rosland |

(56) References Cited

U.S. PATENT DOCUMENTS

| | | | | |
|---|---|---|---|---|
| 8,001,638 | B1 | 8/2011 | Quinter et al. | |
| D648,211 | S | 11/2011 | Weaver et al. | |
| D653,895 | S | 2/2012 | Reisenhus | |
| D665,449 | S | 8/2012 | Guirlinger | |
| 8,250,689 | B2 | 8/2012 | Gladney | |
| 8,356,372 | B2 | 1/2013 | Smalling et al. | |
| D694,042 | S | 11/2013 | Yiannaki | |
| 2002/0069462 | A1* | 6/2002 | Gaboury et al. | 5/201 |
| 2003/0074736 | A1 | 4/2003 | Grothaus | |
| 2003/0079284 | A1* | 5/2003 | Gaboury et al. | 5/201 |
| 2003/0173814 | A1* | 9/2003 | Wieland et al. | 297/440.1 |
| 2004/0128761 | A1* | 7/2004 | Gaboury et al. | 5/400 |
| 2004/0128773 | A1 | 7/2004 | Barber | |
| 2004/0133988 | A1 | 7/2004 | Barber | |
| 2004/0182802 | A1 | 9/2004 | Paul | |
| 2004/0187217 | A1 | 9/2004 | Barman et al. | |
| 2004/0261186 | A1 | 12/2004 | Gladney | |
| 2005/0015884 | A1 | 1/2005 | Conaway et al. | |
| 2005/0028275 | A1 | 2/2005 | Hooper, Jr. | |
| 2005/0204475 | A1 | 9/2005 | Schmitz et al. | |
| 2005/0246839 | A1 | 11/2005 | Niswonger | |
| 2005/0251920 | A1 | 11/2005 | Ahn | |
| 2005/0262642 | A1 | 12/2005 | Miller | |
| 2006/0031995 | A1 | 2/2006 | Barkhouse | |
| 2006/0042016 | A1 | 3/2006 | Barman et al. | |
| 2006/0260062 | A1 | 11/2006 | Barman et al. | |
| 2007/0118987 | A1 | 5/2007 | Gladney et al. | |
| 2008/0040861 | A1 | 2/2008 | Ootayopas | |
| 2008/0115288 | A1 | 5/2008 | Poulos | |
| 2009/0000030 | A1 | 1/2009 | Hicks et al. | |
| 2009/0011203 | A1 | 1/2009 | Mock et al. | |
| 2009/0013476 | A1 | 1/2009 | Rinchetti | |
| 2009/0025150 | A1 | 1/2009 | Smalling et al. | |
| 2009/0031502 | A1 | 2/2009 | Berrcocal et al. | |
| 2009/0100606 | A1 | 4/2009 | An | |
| 2009/0106894 | A1 | 4/2009 | Yeo | |
| 2009/0139033 | A1 | 6/2009 | Gladney | |
| 2009/0294623 | A1 | 12/2009 | Pinchuk | |
| 2010/0071136 | A1 | 3/2010 | Weber | |
| 2010/0077552 | A1 | 4/2010 | Malikhin et al. | |
| 2010/0319137 | A1* | 12/2010 | Witherell et al. | 5/717 |
| 2010/0325806 | A1 | 12/2010 | Letton et al. | |
| 2011/0049327 | A1 | 3/2011 | Young et al. | |
| 2011/0061163 | A1 | 3/2011 | Lee | |
| 2011/0179579 | A1 | 7/2011 | Henderson et al. | |
| 2011/0197368 | A1 | 8/2011 | Tarazona De La Asuncion | |
| 2012/0167312 | A1 | 7/2012 | Sobran et al. | |
| 2012/0180224 | A1 | 7/2012 | Demoss et al. | |
| 2012/0284928 | A1 | 11/2012 | Henderson et al. | |

FOREIGN PATENT DOCUMENTS

| | | | |
|---|---|---|---|
| GB | 2154443 | A | 9/1985 |
| WO | 2009014657 | A1 | 1/2009 |
| WO | 2010117352 | A1 | 10/2010 |

OTHER PUBLICATIONS

"Corner 'S; Tube 4.5 inch Final Spec," Product Specifications, Nomaco Inc., Mar. 2, 2010, 1 page.
"Mattress Innerspring/Innercore having Side and Corner Support Profiles," Nomaco, Inc., Jan. 2009, 1 page.
"Ultra Corner II 5.5 inch," Product Specifications, Nomaco, Inc., Mar. 3, 2010, 1 page.
Final Office Action mailed Nov. 8, 2011 for U.S. Appl. No. 12/455,968, 13 pages.
Non-final Office Action mailed May 26, 2010 for U.S. Appl. No. 12/455,968, 13 pages.
Non-final Office Action mailed Oct. 12, 2011 for U.S. Appl. No. 12/455,968, 12 pages.
Notice of Allowance mailed Dec. 31, 2009 for U.S. Appl. No. 29/342,503, 4 pages.
Non-final Office Action mailed Sep. 13, 2011 for U.S. Appl. No. 12/386,584, 18 pages.
"Expandable Grids Made of ETHOFOAM Brand Polyethylene Foam," ETHAFOAM, Dec. 1997, 7 pages.
Non-final Office Action for U.S. Appl. No. 12/386,584 mailed Feb. 3, 2012, 17 pages.
"Flagship series side supports shown on traditional coil innerspring with borderwire," Nomaco, Date, Unknown, 1 page.
"Luxury foam side supports shown on both metal coil and on pocketed coil innerspring," Nomaco, Date Unknown, 2 pages.
"Horizontal polymer foam bases no sides shown (reference only)," Nomaco, Date Unknown, 1 page.
Non-final Office Action for U.S. Appl. No. 29/398,647 mailed May 8, 2012, 6 pages.
Notice of Allowance mailed May 9, 2012, for U.S. Appl. No. 29/398,649, 8 pages.
Notice of Allowance for U.S. Appl. No. 29/342,503 mailed Dec. 16, 2009, 6 pages.
Non-final Office Action for U.S. Appl. No. 13/418,649 mailed May 15, 2012, 15 pages.
Notice of Allowance for U.S. Appl. No. 29/361,180 mailed Nov. 27, 2012, 6 pages.
Notice of Allowance for U.S. Appl. No. 12/455,968 mailed Jul. 23, 2012, 7 pages.
Notice of Allowance for U.S. Appl. No. 29/398,649 mailed Aug. 29, 2012, 6 pages.
Notice of Allowance for U.S. Appl. No. 29/398,647 mailed Aug. 30, 2012, 6 pages.
Quayle Action for U.S. Appl. No. 29/361,180 mailed Sep. 13, 2012, 11 pages.
Notice of Allowance for U.S. Appl. No. 29/403,050 mailed Sep. 28, 2012, 8 pages.
Notice of Allowance for U.S. Appl. No. 13/418,649 mailed Dec. 12, 2012, 7 pages.
Non-final Office Action for U.S. Appl. No. 13/534,068 mailed Jun. 12, 2013, 8 pages.
Notice of Allowance for U.S. Appl. No. 29/368,046 mailed Jul. 1, 2013, 8 pages.
Non-final Office Action for U.S. Appl. No. 29/368,030 mailed Apr. 19, 2013, 7 pages.
Non-final Office Action for U.S. Appl. No. 29/368,039 mailed Apr. 25, 2013, 8 pages.
Non-final Office Action for U.S. Appl. No. 29/368,034 mailed Apr. 24, 2013, 6 pages.
Non-final Office Action for U.S. Appl. No. 12/615,535 mailed Feb. 28, 2013, 14 pages.
Non-final Office Action for U.S. Appl. No. 12/694,562 mailed Feb. 28, 2013, 13 pages.
Non-final Office Action for U.S. Appl. No. 29/368,046 mailed Mar. 8, 2013, 6 pages.
Notice of Allowance and Examiner-Initiated Interview Summary for U.S. Appl. No. 12/615,535 mailed Jul. 17, 2013, 13 pages.
Non-final Office Action for U.S. Appl. No. 12/694,562 mailed Sep. 11, 2013, 11 pages.
Notice of Allowance for U.S. Appl. No. 29/368,030 mailed Aug. 5, 2013, 8 pages.
Final Office Action for U.S. Appl. No. 29/368,039 mailed Aug. 5, 2013, 6 pages.
Notice of Allowance for U.S. Appl. No. 29/368,039 mailed Sep. 23, 2013, 9 pages.
Notice of Allowance for U.S. Appl. No. 29/368,034 mailed Sep. 24, 2013, 15 pages.
Official Action for Mexican patent application MX/a/2010/006786 mailed Oct. 7, 2013, 2 pages.
Non-final Office Action for U.S. Appl. No. 13/534,068 mailed Oct. 3, 2013, 9 pages.

* cited by examiner

ASSEMBLIES, SYSTEMS, AND RELATED METHODS EMPLOYING INTERLOCKING COMPONENTS TO PROVIDE AT LEAST A PORTION OF AN ENCASEMENT, PARTICULARLY FOR BEDDING AND SEATING APPLICATIONS

RELATED APPLICATIONS

The present application claims priority to U.S. Provisional Patent Application No. 61/237,498, filed Aug. 27, 2009, entitled "ENCASEMENT ASSEMBLIES, SYSTEMS, AND RELATED METHODS EMPLOYING FLIP-UP SUPPORT MEMBER(S), PARTICULARLY FOR BEDDING AND SEATING APPLICATIONS," which is herein incorporated by reference in its entirety.

FIELD OF THE DISCLOSURE

The technology of the disclosure relates to encasements, encasement assemblies, systems, and related methods providing support, including perimeter, edge, side, and internal support, which may be employed in bedding and seating applications.

BACKGROUND

Innerspring assemblies for mattresses or seating structures can be composed of a plurality of spring coils tied together in a matrix or array. An example of such an innerspring assembly is illustrated by the mattress 1 of FIG. 1. As illustrated therein, a mattress innerspring 2 (also called "innerspring 2") is provided. The innerspring 2 is comprised of a plurality of traditional coils 3 arranged in an interconnected matrix to form a flexible core structure and support surfaces of the mattress. The coils 3 are also connected to each other through interconnection helical wires 4. Upper and lower border wires 5, 6 are attached to upper and lower end turns of the coils 3 at the perimeter of the array to create a frame for the innerspring 2. The upper and lower border wires 5, 6 also create firmness for edge support on the perimeter of the innerspring 2 where an individual may disproportionally place force on the innerspring 2, such as during mounting onto and dismounting from the mattress 1. The innerspring 2 is disposed on top of a box spring 7 to provide base support.

With regard to an edge 8 of the innerspring 2, there are some general considerations regarding construction and manufacture. In normal use, the edge 8 is subjected to greater compression forces than an interior 9 of the innerspring 2 due to the common practice of sitting on the edge 8 of the mattress 1. The coils 3 located proximate to the edge 8 of the innerspring 2 are subjected to concentrated loads as opposed to coils 3 located in the interior 9. To provide further perimeter structure and edge-support for the innerspring 2, support members 10 may be disposed around the coils 3 disposed proximate to the edge 8 of the innerspring 2 between the box spring 7 and the upper and lower border wires 5, 6. The support members 10 may be extruded from polymer-foam as an example. One or more layers of sleeping surface or padding material 11 can be disposed on top of the innerspring 2, and upholstery 12 is placed around the entire padding material 11, innerspring 2, and box spring 7 to provide a fully assembled mattress 1. This mattress structure in FIG. 1 may also be provided for other types of innersprings, including pocketed coils.

Labor is expended assembling the support members 10 for the innerspring 2. For example, the support members 10 must be assembled to provide the interior 9 for the innerspring 2 to be located and disposed. It would be desirable to provide for the support members 10 to be able to be easily and quickly assembled for the innerspring 2 to provide efficient assembly and lower cost assembly labor.

SUMMARY OF THE DETAILED DESCRIPTION

Embodiments disclosed herein include encasement assemblies, systems, and related methods employing interlocking support components to provide at least a portion of an encasement, particularly for bedding and seating applications. In this regard in one embodiment, an assembly for bedding or seating is provided. The assembly includes a base having one or more elongated channels disposed therein having a first geometry. The assembly also includes one or more elongated support members each having a rail disposed therein and having a second geometry complimentary to the first geometry. Each rail can be interlocked with at least one of the one or more elongated channels such that the one or more elongated support members are attached to the base and extend from the base to provide at least a portion of an encasement. In this manner, an encasement, or portion thereof, can easily and conveniently be assembled from support components adapted to be assembled together. Further, different configurations of attaching elongated support members to the base can be provided at the discretion of the assembler. Adhesives or other fasteners can be employed to provide additional attachment support, but are not required.

In another embodiment, a method of forming at least a portion of an encasement for an assembly for bedding or seating is provided. The method includes providing a base. The method also includes disposing one or more elongated channels having a first geometry in the base. The method also includes providing one or more elongated support members each having a rail disposed therein and having a second geometry complimentary to the first geometry. The method also includes disposing the rail of the one or more elongated support members into at least one of the one or more elongated channels to interlock the one or more elongated support members to the base to attach the one or more elongated support members to the base to provide at least a portion of an encasement.

The assembly may also include a flip-up support member (s) disposed in the base to form at least a portion of the encasement. Thus, other embodiments disclosed herein can also include encasement assemblies, systems, and related methods employing flip-up support. Flip-up support members can also be used in conjunction with the interlocking elongated support members to provide a portion or an entire encasement. The flip-up support member may include perimeter, edge, side, and/or internal support. In one embodiment, a base or deck is provided that forms at least a part of an encasement. At least one hinge is disposed along an axis of the base to form a flip-up support member in the base. In one embodiment, the hinge is a living hinge formed as a result of extrusion or disposing one or more cuts in the base. The living hinge may be disposed adjacent a side or end of the base. In this manner, the flip-up side support member formed as a result of the living hinge disposed in the base can be flipped-up or rotated about the living hinge to provide a side or edge support for the base. The flip-up side support member forms at least a portion of an encasement.

More than one hinge can be disposed in the base to form additional flip-up side-support members to form additional sides or edges around the base to form a part of the encasement. Flip-up side-support members can be disposed in the base to form the entire perimeter area around the base to form an encasement in one embodiment. In this manner, the encasement is formed from one-piece entirely comprised of a base.

Alternatively, in other embodiments, additional separate side-support members may be provided and attached to the base to form a perimeter of the encasement in cooperation with flip-up side support members. In one embodiment, the base may include one or more elongated channels that are configured to receive a rail disposed in the additional side-support members. The elongated channels may be provided in the form of T-shaped, dovetail-shaped or other locking-shaped geometry that is designed to receive complimentary portions of the rail in certain embodiments. Additional locking-geometry such as T-shaped or dovetail-shaped portions may be disposed on ends of the additional side-support members to also engage with portions of the elongated channels disposed in the flip-up side support members after the being flipped-up or set about the base. The ends of the additional side-support members may be attached to the ends of the flip-up side support members to form a perimeter around the base. Alternatively or in addition, an adhesive or other bonding method may be used to attach or reinforce attachment of the additional side-support members to the base and/or the flip-up side support members. Additional side-support members may also be disposed in an internal area of the encasement to provide additional support, such as lumbar support as an example, and/or differing degrees of firmness.

A support structure(s) may be disposed in an internal area formed inside the perimeter area of the encasement to provide a bedding or cushioning application. For example, coiled springs, pocketed coils, or a combination of both may be disposed in the internal area of the encasement to collectively form an innerspring assembly. A core material, such as latex or visco-elastic material, may also be disposed in the internal area of the encasement to form a core assembly. The support structure(s) can provide a sleep or rest surface or a portion of a sleep or rest surface.

Additional features and advantages will be set forth in the detailed description which follows, and in part will be readily apparent to those skilled in the art from that description or recognized by practicing the invention as described herein, including the detailed description that follows, as well as the appended drawings.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

DETAILED DESCRIPTION

Figure 1:
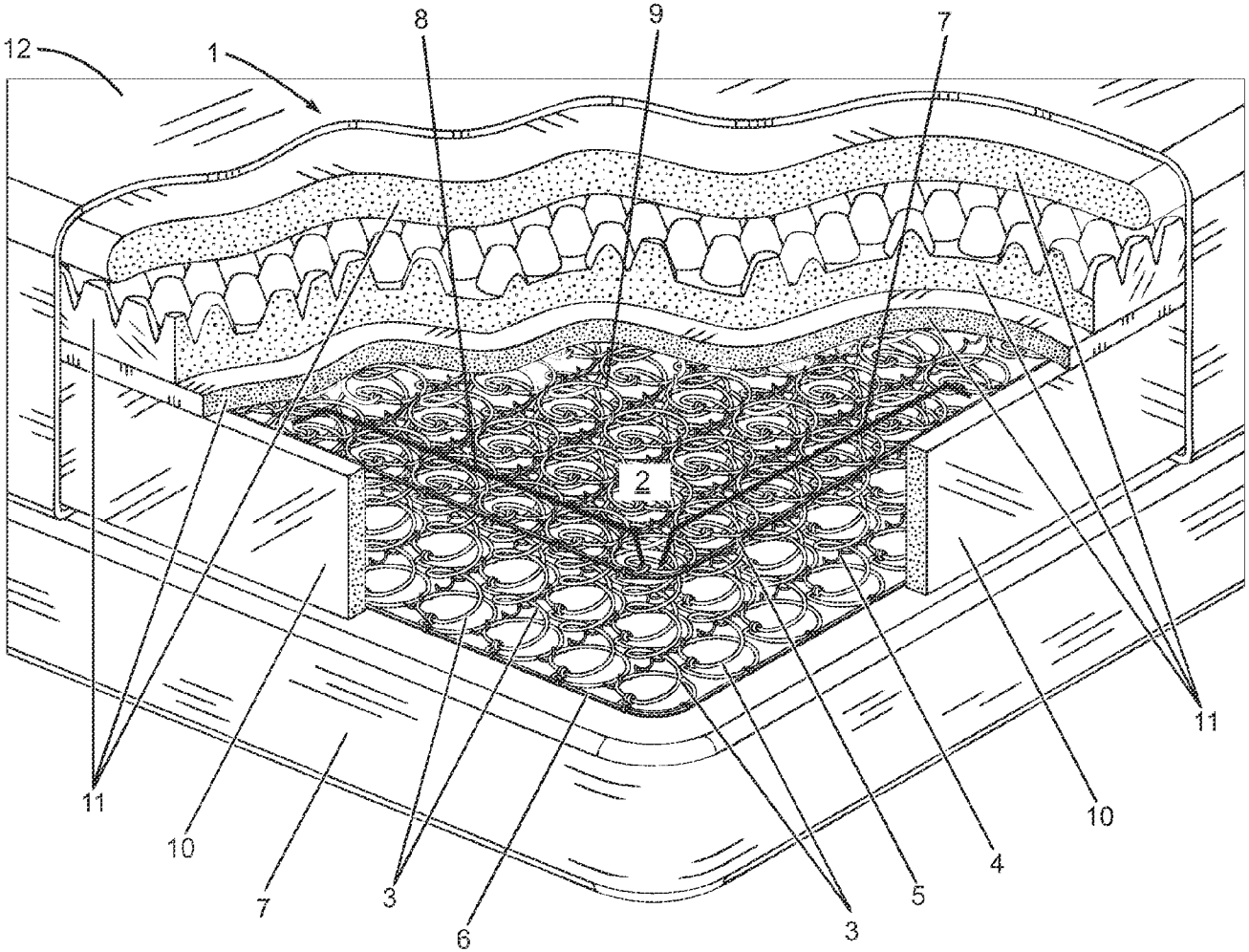
FIG. 1 PRIOR ART
FIG. 1 is an exemplary innerspring assembly.

Embodiments disclosed herein include encasement assemblies, systems, and related methods employing interlocking support components to provide at least a portion of an encasement, particularly for bedding and seating applications. In this regard in one embodiment, an assembly for bedding or seating is provided. The assembly includes a base having one or more elongated channels disposed therein having a first geometry. The assembly also includes one or more elongated support members each having a rail disposed therein and having a second geometry complimentary to the first geometry. Each rail can be interlocked with at least one of the one or more elongated channels such that the one or more elongated support members are attached to the base and extend from the base to provide at least a portion of an encasement. In this manner, an encasement, or portion thereof, can easily and conveniently be assembled from support components adapted to be assembled together. Further, different configurations of attaching elongated support members to the base can be provided at the discretion of the assembler. Adhesives or other fasteners can be employed to provide additional attachment support, but are not required.

In another embodiment, a method of forming at least a portion of an encasement for an assembly for bedding or seating is provided. The method includes providing a base. The method also includes disposing one or more elongated channels having a first geometry in the base. The method also includes providing one or more elongated support members each having a rail disposed therein and having a second geometry complimentary to the first geometry. The method also includes disposing the rail of the one or more elongated support members into at least one of the one or more elongated channels to interlock the one or more elongated support members to the base to attach the one or more elongated support members to the base to provide at least a portion of an encasement.

The assembly may also include a flip-up support member (s) disposed in the base to form at least a portion of the encasement. Thus, other embodiments disclosed herein can also include encasement assemblies, systems, and related methods employing flip-up support. Flip-up support members can also be used in conjunction with the interlocking elongated support members to provide a portion or an entire encasement. The flip-up support member may include perimeter, edge, side, and/or internal support. In one embodiment, a base or deck is provided that forms at least a part of an encasement. At least one hinge is disposed along an axis of the base to form a flip-up support member in the base. In one embodiment, the hinge is a living hinge formed as a result of extrusion or disposing one or more cuts in the base. The living hinge may be disposed adjacent a side or end of the base. In this manner, the flip-up side support member formed as a result of the living hinge disposed in the base can be flipped-up or rotated about the living hinge to provide a side or edge support for the base. The flip-up side support member forms at least a portion of an encasement.

Figure 2A:
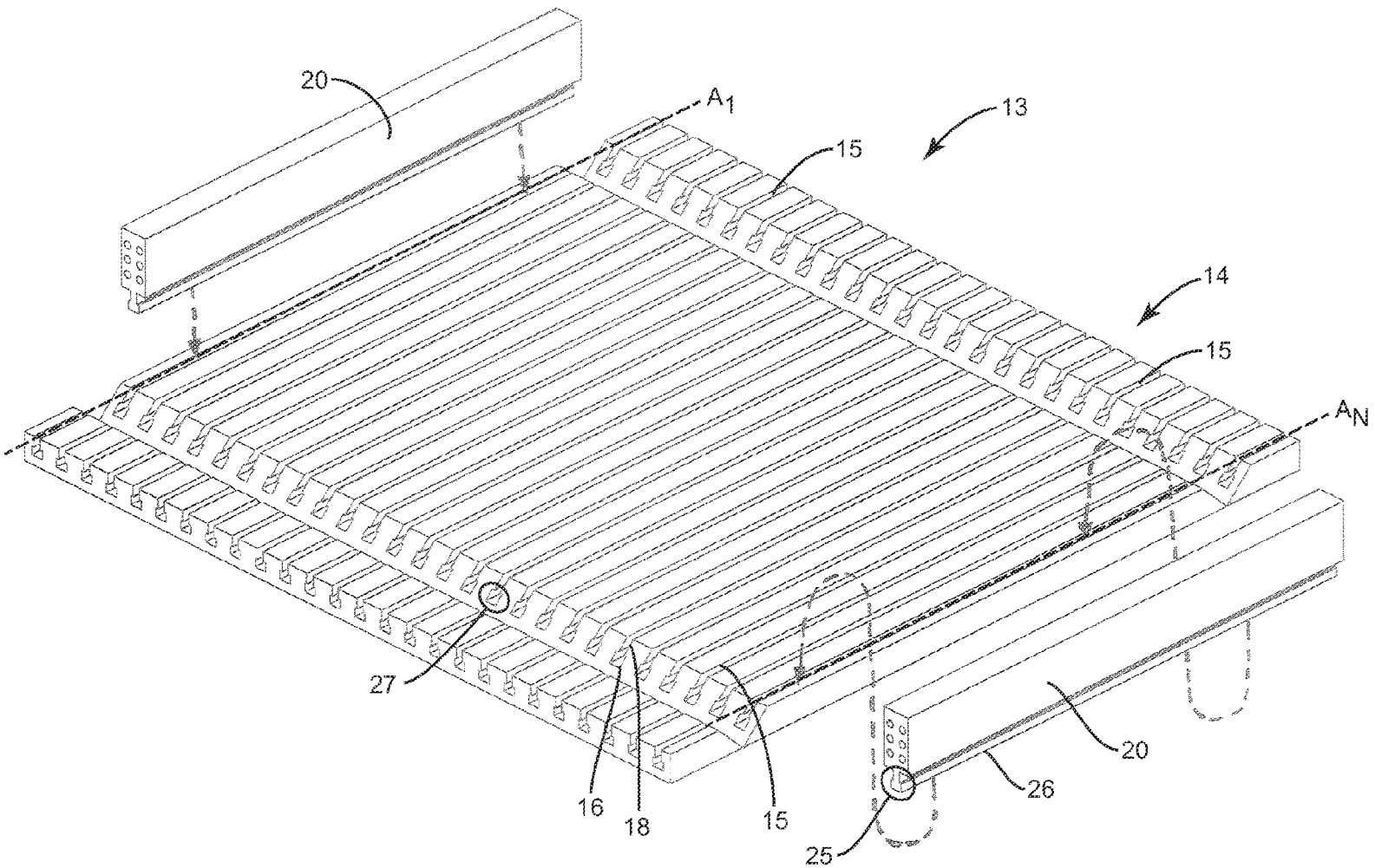
FIG. 2A is a first exemplary embodiment of an unassembled encasement comprised of a base having elongated channels for supporting side-support members and having living hinges disposed therein to provide flip-up side-support members.

In this regard, FIG. 2A illustrates an exemplary encasement 13 that includes perimeter or side-support. Perimeter or side-support can also be known as edge support. The encasement 13 may be used to provide an innerspring or core assembly, such as for bedding or cushioning applications, as examples. As illustrated in FIG. 2A, the encasement 13 is provided in an unassembled form for illustration purposes. To provide perimeter or side support, this embodiment of the encasement 13 includes a base 14. The base 14 in this embodiment is constructed out of polymer foam as an example, but may be constructed out of any other material or composition desired. For example, side-support members 20 may be constructed from engineered polymer foam. In this manner, more expensive edge or perimeter structures, like steel borderwires, firmer spring-coils, or other costly composites, as examples, may be avoided while still providing side or edge support. A plurality of elongated channels 15 are disposed along longitudinal axes $A_1$-$A_N$ in the base 14, as illustrated in FIG. 2A. For example, the elongated channels 15 may be disposed in the base 14 through a foam extrusion process. The elongated channels 15 in this embodiment are female channels configured to receive male counterparts for side-support, as will be described in greater detail below. The elongated channels 15 have a greater width at a base 16 of the elongated channels 15 than at an upper portion 18 of the elongated channels 15 to provide T-shaped elongated channels 15 in this embodiment. In this manner, one or more side-support members 20 can be attached in any of the elongated channels 15 to provide side-support as desired.

Figure 2B:
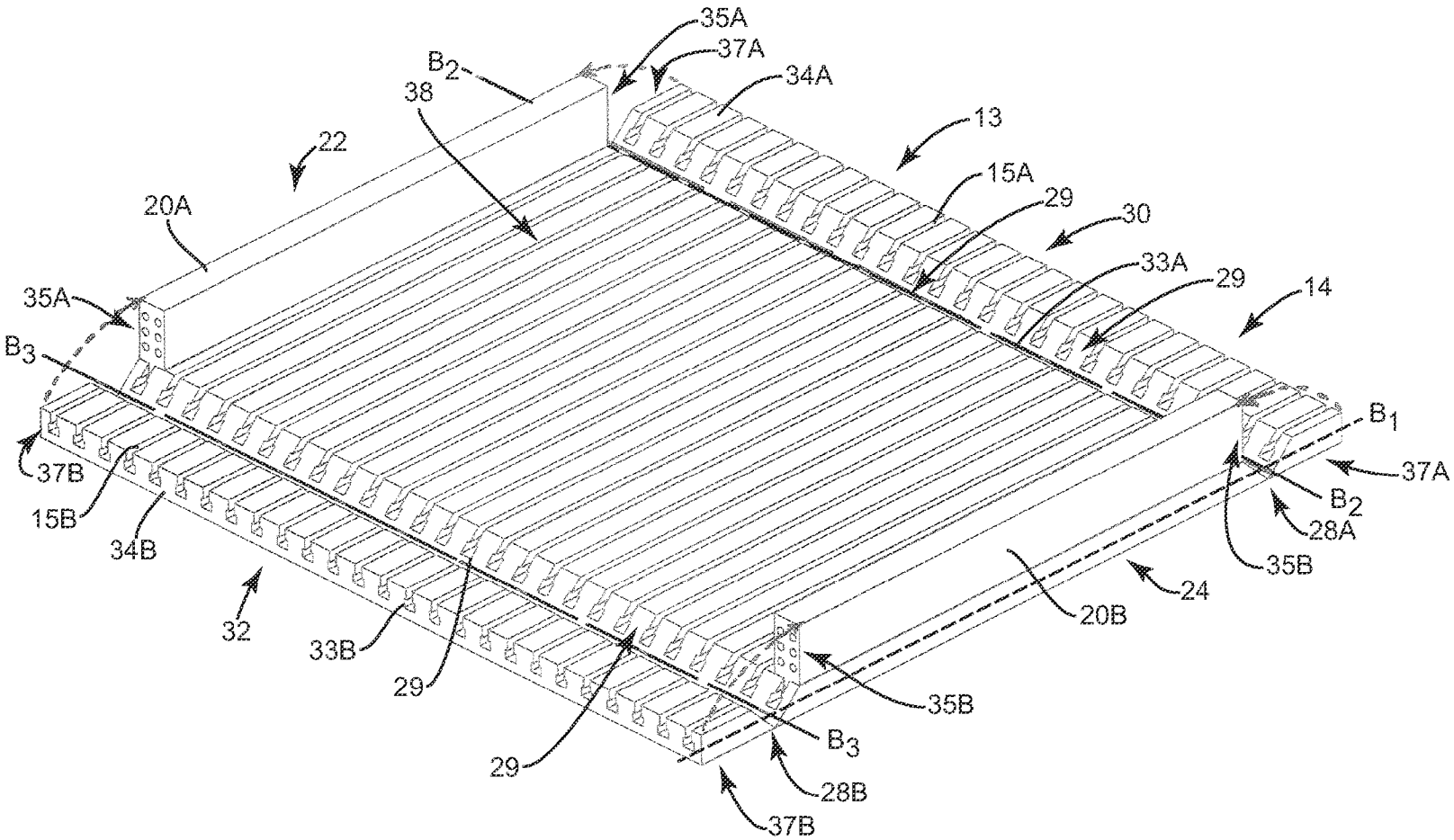
FIG. 2B is the encasement of FIG. 2A with side-support members having a rail engaged within elongated channels at the head end and foot end of the base before the flip-up side-support members are flipped-up or set about the base.

For example, as illustrated in FIG. 2B, two side-support members 20A, 20B are attached to the base 14 via engagement with elongated channels 15 disposed on a head end 22 and a foot end 24 of the base 14 to provide head end and foot end side support for the encasement 13. However, the elongated channels 15 could also be disposed perpendicular to longitudinal axes $A_1$-$A_N$ in the base 14 or in other directions between first and second side ends 30, 32 of the base 14 such that the side-support members 20A, 20B could be engaged therein to provide support on other ends, sides, or areas of the base 14, as desired. In this embodiment as illustrated in FIG. 2A, the side-support members 20A, 20B are either cut or extruded to include a rail 26. The rail 26 is configured to engage with one of the elongated channels 15 secure the side-support members 20A, 20B to the base 14 to form part of the encasement 13 and provide side or edge support. In this embodiment, the rail 26 is provided in the form of a male T-shaped portion 25 (FIG. 2A) to be complementary with a female T-shaped portion 27 (FIG. 2A) in the elongated channels 15 disposed in the base 14. Other designs can be employed. The male T-shaped portion 25 disposed in the rail 26 of the side-support members 20A, 20B is engaged in an elongated channel 15 disposed in the base 14, as illustrated in FIG. 2B. In this embodiment, the side-support members 20A, 20B are installed on perimeter elongated channels 15A, 15B to provide support on the head end 22 and foot end 24 of the base 14. Because of the T-shaped design, the rail 26 of the side-support members 20A, 20B interlocks with the elongated channel 15. Alternatively, the T-shaped portion 25 provided in the rail 26 could be a female portion, and the T-shaped portion 27 provided in the elongated channels 15 could be a male portion. To further secure the side-support members 20A, 20B to an elongated channel 15, an adhesive could also be employed and applied to the rail 26 and/or the elongated channel 15. An adhesive or other bonding method could be employed in lieu of the T-shaped portions 25, 27. Alternatively or in addition, a weld could be applied between the rail 26 and the elongated channel 15 and/or portions disposed adjacent thereto in the side-support members 20A, 20B and/or the base 14 to secure the side-support members 20A, 20B to the base 14.

Figure 2C:
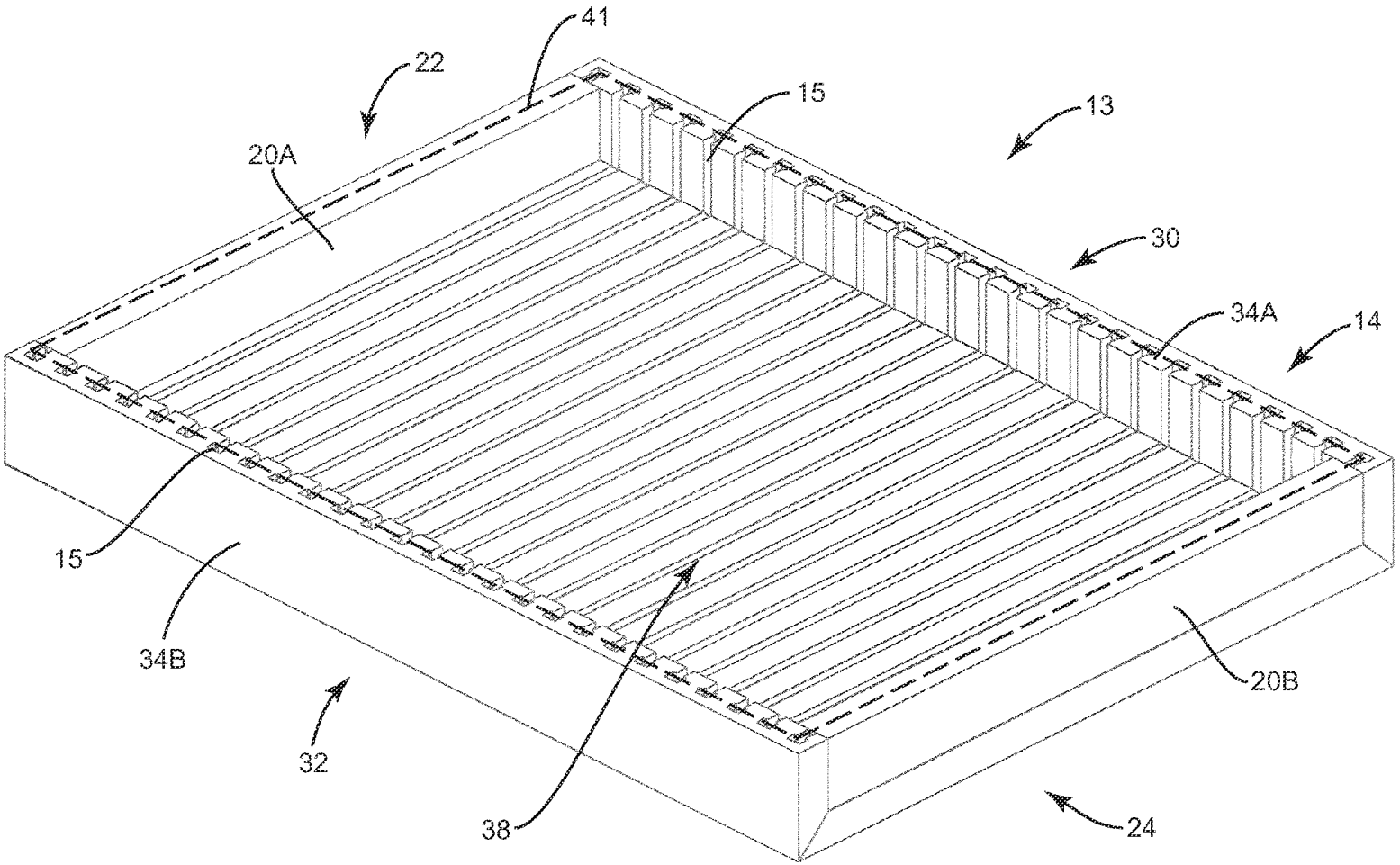
FIG. 2C is an assembled encasement comprised of the base and side-support members engaged with the elongated channels in FIG. 2B with the flip-up side-support members flipped-up or set about the living hinges disposed in the base and attached on ends to the side-support members to provide perimeter support around an internal area within the encasement.

With continuing reference to FIG. 2B, in this embodiment, to complete the assembly of the encasement 13, a contour cut 28 is also placed in the base 14 on both a first side end 30 and a second side end 32 of the base 14 perpendicular to the head end 22 and foot end 24 of the base 14. In this embodiment, two sets of contours cuts 28A, 28B are disposed in the base 14, one set 28A on the first side end 30 and one set 28B on the second side end 32. Each contour cut 28 is disposed at an approximately forty-five degree)(45°) angle with respect to an axis $B_1$, as illustrated in FIG. 2B. Thus, both contour cuts 28A, 28B have faces 29 that are disposed on opposite sides facing each other on both the first side end 30 and the second side end 32 of the base 14 to each form an approximately ninety degree)(90°) angle. As a result, living hinges 33A, 33B are formed along the first side end 30 and second side end 32 of the base 14 where the contour cuts 28A, 28B meet along longitudinal axes $B_2$ and $B_3$ of the base 14, as illustrated in FIG. 2B. In this manner, flip-up side-support members 34A, 34B are formed in the base 14 adjacent the living hinges 33A, 33B on the first and second side ends 30, 32 of the base 14. The flip-up side-support members 34A, 34B can be flipped or rotated and set upward about the living hinges 33A, 33B to form a closed perimeter area around the base 14 to provide an assembled encasement 13, as illustrated in FIG. 2C. As illustrated in FIG. 2B, the ends 37A, 37B of the flip-up side-support members 34A, 34B are configured to be located adjacent to ends 35A, 35B of the side-support members 20A, 20B to provide a closed perimeter area 41 (see FIG. 2C) around the base 14. The ends 37A, 37B of the flip-up side-support members 34A, 34B can be attached to the ends 35A, 35B of the side-support members 20A, 20B. An adhesive may additionally be applied and/or a weld provided to attach the ends 37A, 37B of the flip-up side-support members 34A, 34B to ends 35A, 35B of the side-support members 20A, 20B. When the closed perimeter area 41 is formed around the base 14, an internal area 38 is formed inside the perimeter area 41 of the encasement 13 formed by the side-support members 20A, 20B attached to the flipped-up or set flip-up side-support members 34A, 34B. The internal area 38 can provide an area for disposition of a support material or surface, examples of which will be provided below.

The assembled encasement 13 can provide an encasement and perimeter support for a mattress application, as one example. The side-support members 20, 34 provide side support, namely the first and second side ends 30, 32 and the head end and foot end 22, 24 around the base 14 to form the encasement 13 example of FIG. 2C. As examples of the wide variety of alternate compositions that can be employed and effectively used for support, the base 14 and/or the side-support members 20, 34 may be formed from one or more materials selected from the group consisting of polystyrenes, polyefins, polyethylenes, polybutanes, polybutylenes, polyurethanes, polyesters, ethylene acrylic copolymers, ethylene-vinyl-acetate copolymers, ethylene-methyl acrylate copolymers, ethylene-butyl-acrylate copolymers, ionomers, polypropylenes, copolymers of polypropylene, and the like. Such polymers may be foamed to provide the base 14 and/or the side-support members 20, 34 including either open-cell foam, closed-cell foam, or both open and closed-cell foam. Extrusions may be disposed in the base 14 and/or the side-support members 20, 34 to provide a spring-like structure and/or to use less polymer material to save costs. The density of the base 14 and/or the side-support members 20, 34 may be any density desired.

Figure 2D:
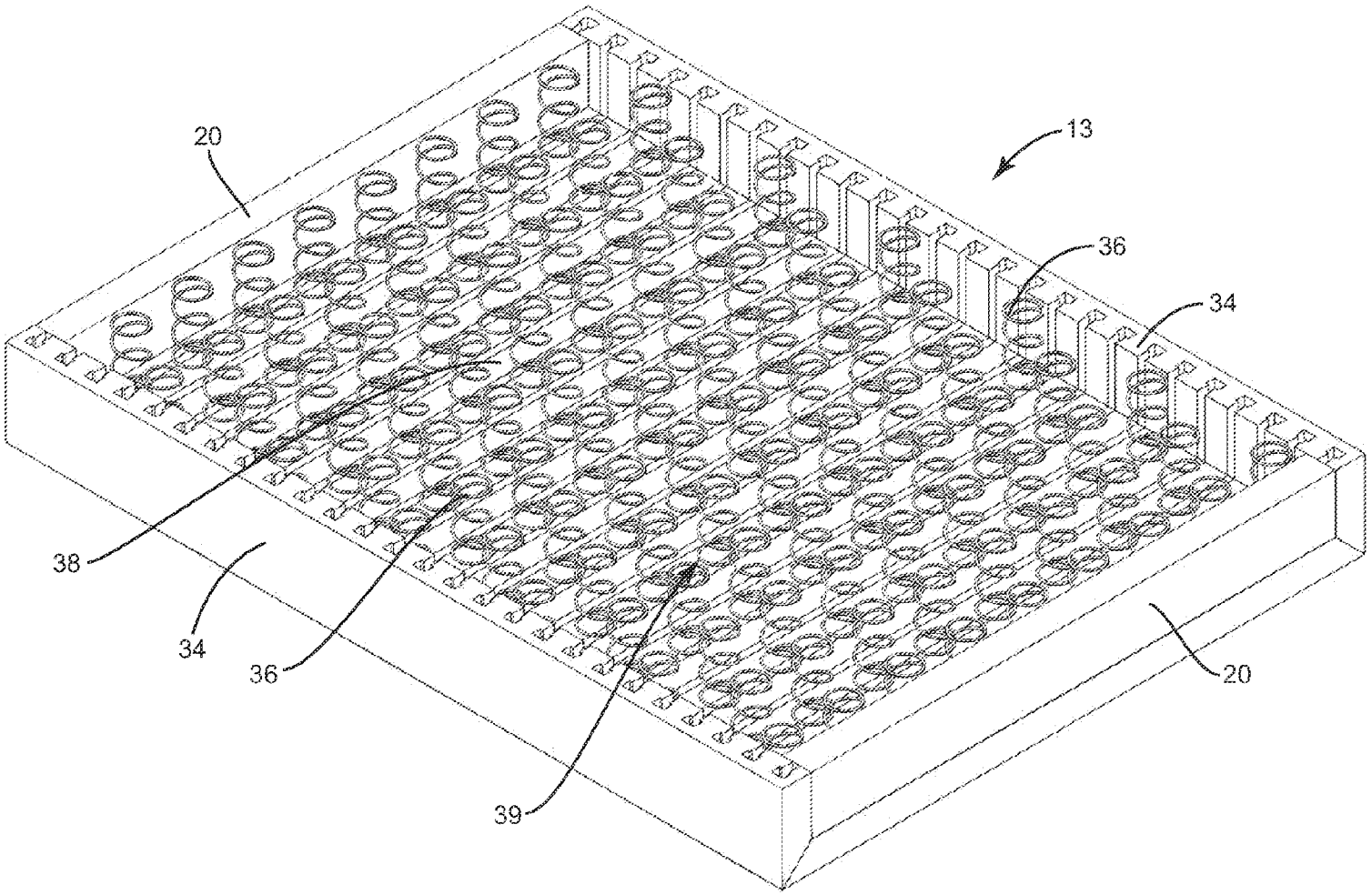
FIG. 2D is the assembled encasement of FIG. 2A having an innerspring comprised of coil springs disposed in an internal area within the encasement to provide an innerspring assembly.

FIG. 2D illustrates one example of an assembly formed by the assembled encasement 13 of FIG. 2C. In this example, coiled springs 36 are disposed inside the internal area 38 of the encasement 13 to form an innerspring assembly 39. In this manner, the coiled springs 36 provide support in the internal area 38 which may form a sleep or rest surface. Bedding or cushioning material may be placed over top the coiled springs 36 in the internal area 38 of the encasement 13 to provide a rest or sleep surface as a further part of the innerspring assembly 39. The side-support members 20, 34 provide side or edge support for the innerspring assembly 39. As an example, the side-support members 20, 34 may be constructed out of a material to have a degree of firmness or support greater than the degree or firmness of the coiled springs 36.

Figure 2E:
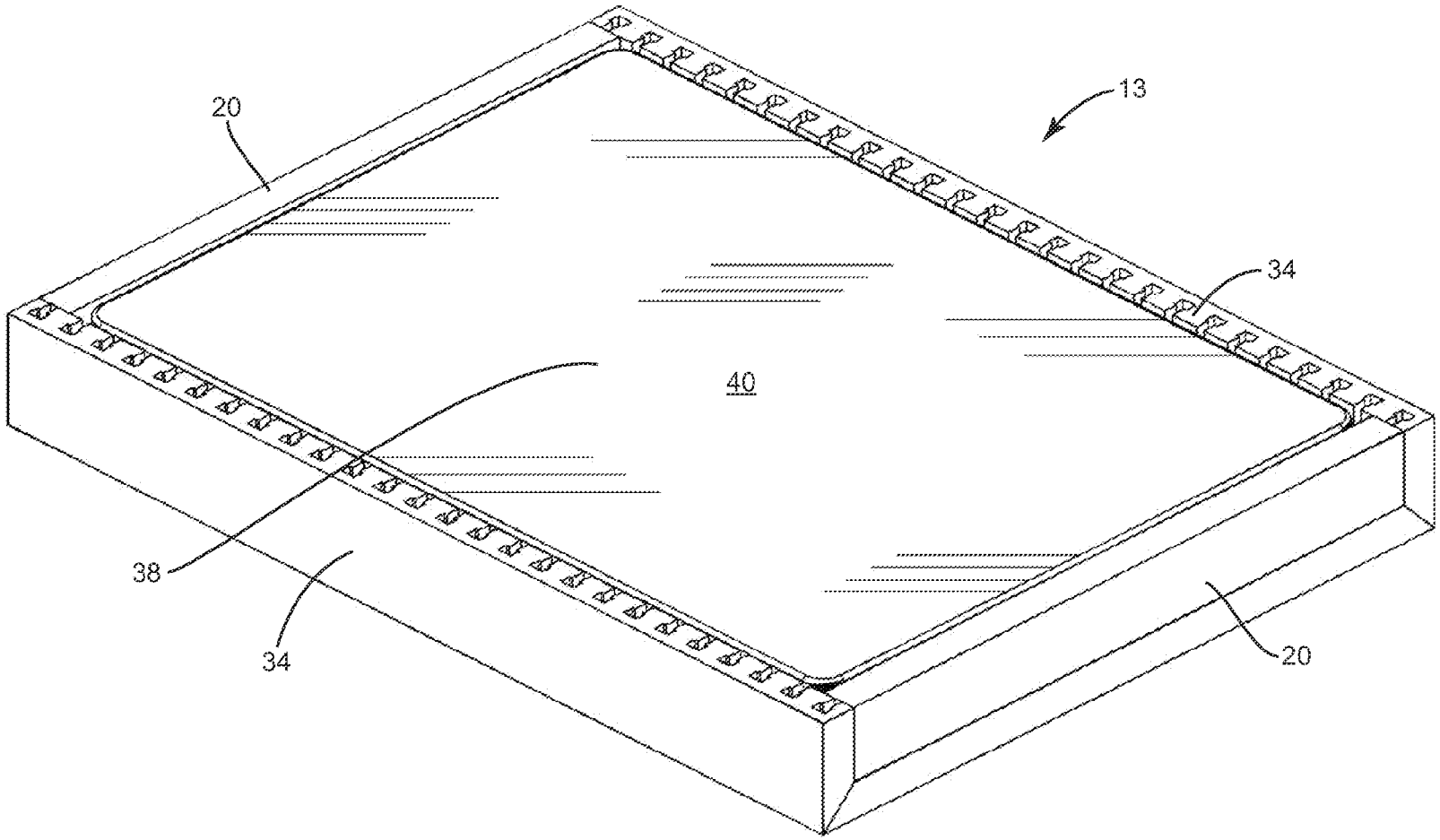
FIG. 2E is the assembled encasement of FIG. 2A having a core disposed in an internal area within the encasement to provide a core assembly.

FIG. 2E illustrates another example wherein instead of coiled springs 36, a core 40 is disposed inside the internal area 38 of the encasement 13, which can be employed to provide a bedding or mattress application as an example. For example, the core 40 could be latex or other thermoelastic materials, and may also be foamed. The core 40 may also be comprised of a composite of thermoplastic and thermoset materials. Examples of thermoplatics have been previously discussed above. One example of a thermoset material is latex foam rubber as one example of a thermoset elastomer. Latex rubber exhibits recovery and lack of compressive set characteristics while maintaining the tactile cushioning. It is a natural material and is considered biodegradable. Latex is hypo-allergenic, and breathes to keep you warm in the winter and cool in the summer. Further, bacteria, mildew, and mold cannot live in latex foam. It is generally obtained in emulsified form and is frothed to introduce air into the emulsion to reduce density and is then cured (vulcanized) to remove additional waters and volatiles as well as to set the material to its final configuration. Used in combination with a latex foam, thermoplastic foams can consume space within a cushion structure thereby displacing the heavier-weight, more expensive latex rubber foam component. The latex rubber foam component can also be further cost reduced through the addition of fillers such as ground foam reclaim materials, nano clays, carbon nano tubes, calcium carbonate, flyash and the like, but also corc dust as this material can provide for increased stability to reduce the overall density and weight of the thermoset material. The core 40 could be formed from a poured mold.

Figure 3A:
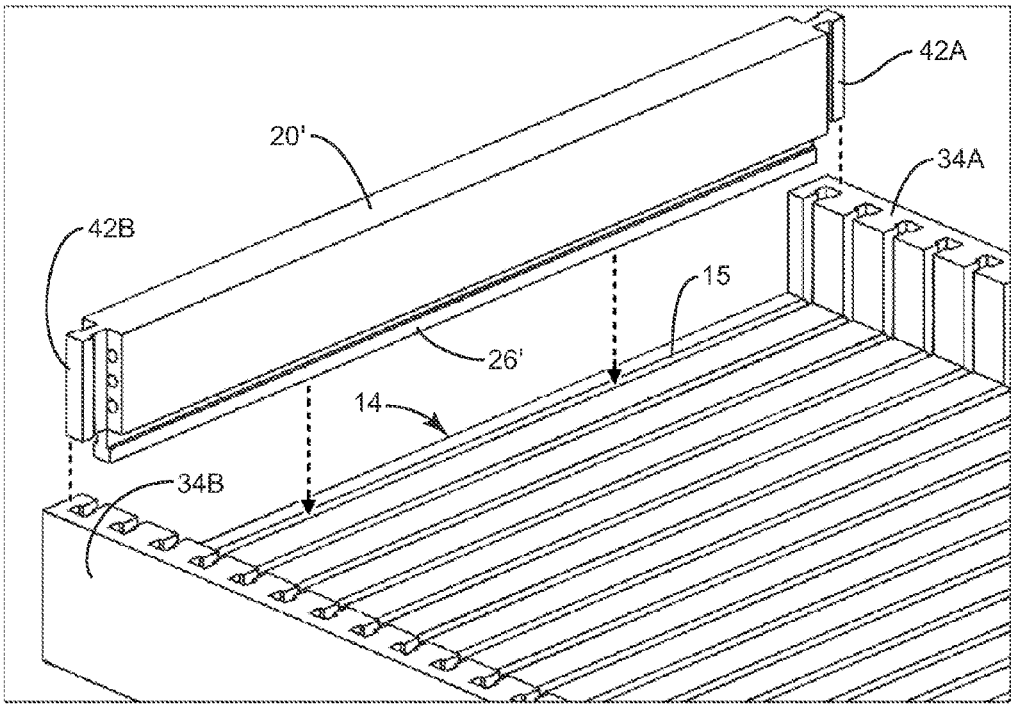
FIGS. 3A and 3B is an alternative side-support member that may be employed in the encasement of FIGS. 2A-2C having locking-geometry such as T-shaped or dovetail-shaped portions additionally disposed on end portions of the side-support members configured to engage with elongated channels disposed in the flip-up side-support members when flipped-up or set about the base.
Figure 3B:
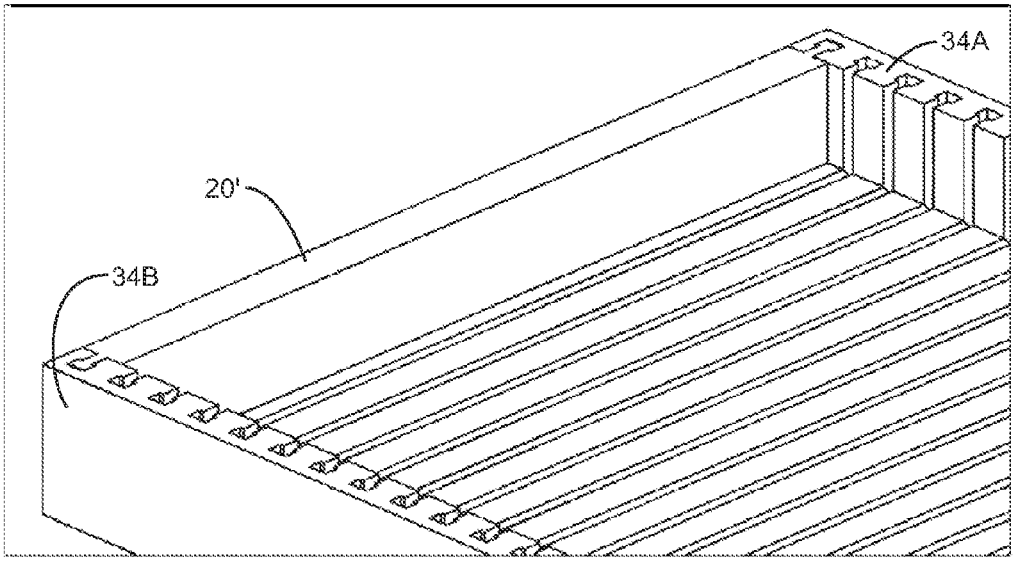

FIGS. 3A and 3B illustrate alternative embodiments of the side-support member 20, which are referenced as 20' in FIGS. 3A and 3B. FIG. 3A illustrates the side-support member 20' before being installed in the base 14. FIG. 3B illustrates the side-support member 20' after being installed in the base 14 and secured to the flip-up side-support members 34A, 34B. The side-support member 20' illustrated in FIGS. 3A and 3B may be used as an alternative to any of the side-support members 20A, 20B in FIGS. 2A-2E. In this embodiment, in addition to rails 26' being disposed in the side-support members 20 to engage with the elongated channels 15 in the base 14, additional rails 42A, 42B are also disposed on ends 44 of the side-support member 20'. In this embodiment, two rails 42A, 42B are provided, but one rail 42A and/or 42B may also be provided. In this embodiment, the rails 42A, 42B are disposed approximately perpendicular to the rails 26' in the side-support members 20' in this embodiment. In this manner, when the rail 26 of the side-support member 20' is engaged and interlocked into an elongated channels 15, the rails 42A, 42B in the side-support member 20' are also configured to engage with the elongated channels 15 that are disposed in the flip-up side-support members 34A, 34B of the base 14 to further secure the side-support members 20' to the flip-up side-support members 34A, 34B as part of the encasement 13. An adhesive or glue may also be employed or weld provided between the rails 42A, 42B and the elongated channel 15 to secure the side-support member 20'.

Figure 4A:
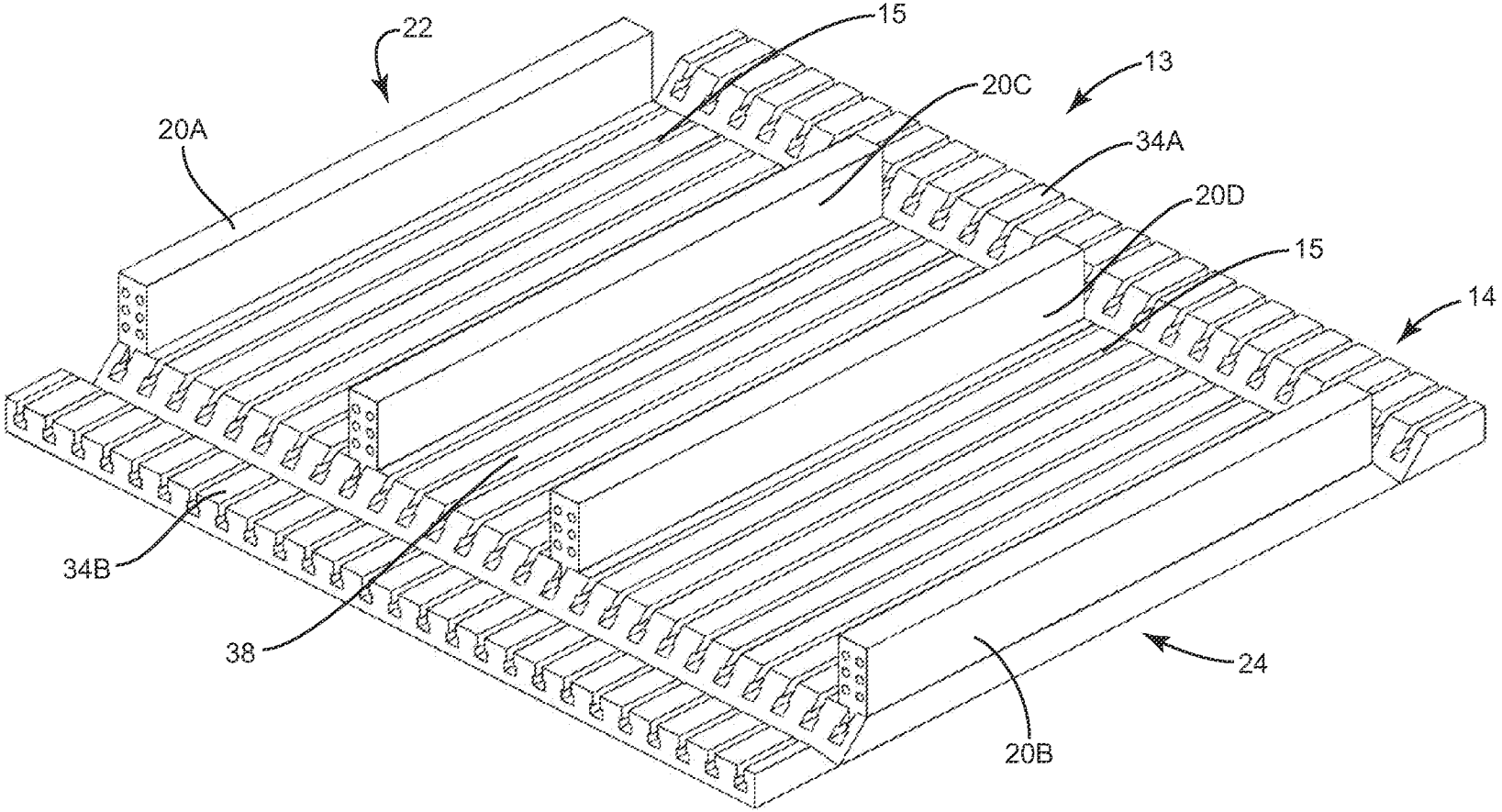
FIGS. 4A-4C illustrate the encasement of FIGS. 2A-2C with additional side-support members engaged with elongated channels in an internal portion of the encasement to provide additional support, such as lumbar support for example, between a head end and foot end of the encasement.

FIGS. 4A-4D illustrate yet another embodiment of an encasement. The encasement in FIGS. 4A-4D is the same encasement 13 as provided in FIGS. 2A-2C. However, in this embodiment, additional intermediate support members 20C, 20D are engaged in the elongated channels 15 in areas of the base 14 and between the head end 22 and the foot end 24 of the encasement 13 within the internal area 38 of the encasement 13. The support members 20C, 20D are the same design as the side-support members 20A, 20B in FIGS. 2A-2C in this embodiment, except that they are disposed in the internal area 38 of the encasement 13. For example, these additional support members 20C, 20D may provide lumbar support for a mattress or bedding application whereby stiffer or firmer regions may be disposed in the internal area 38 of the encasement 13. One or more than two support members may alternatively be provided. FIG. 4A illustrates the additional support members 20C, 20D engaged with the elongated channels 15 between the head end 22 and the foot end 24 of the base 14.

Figure 4B:
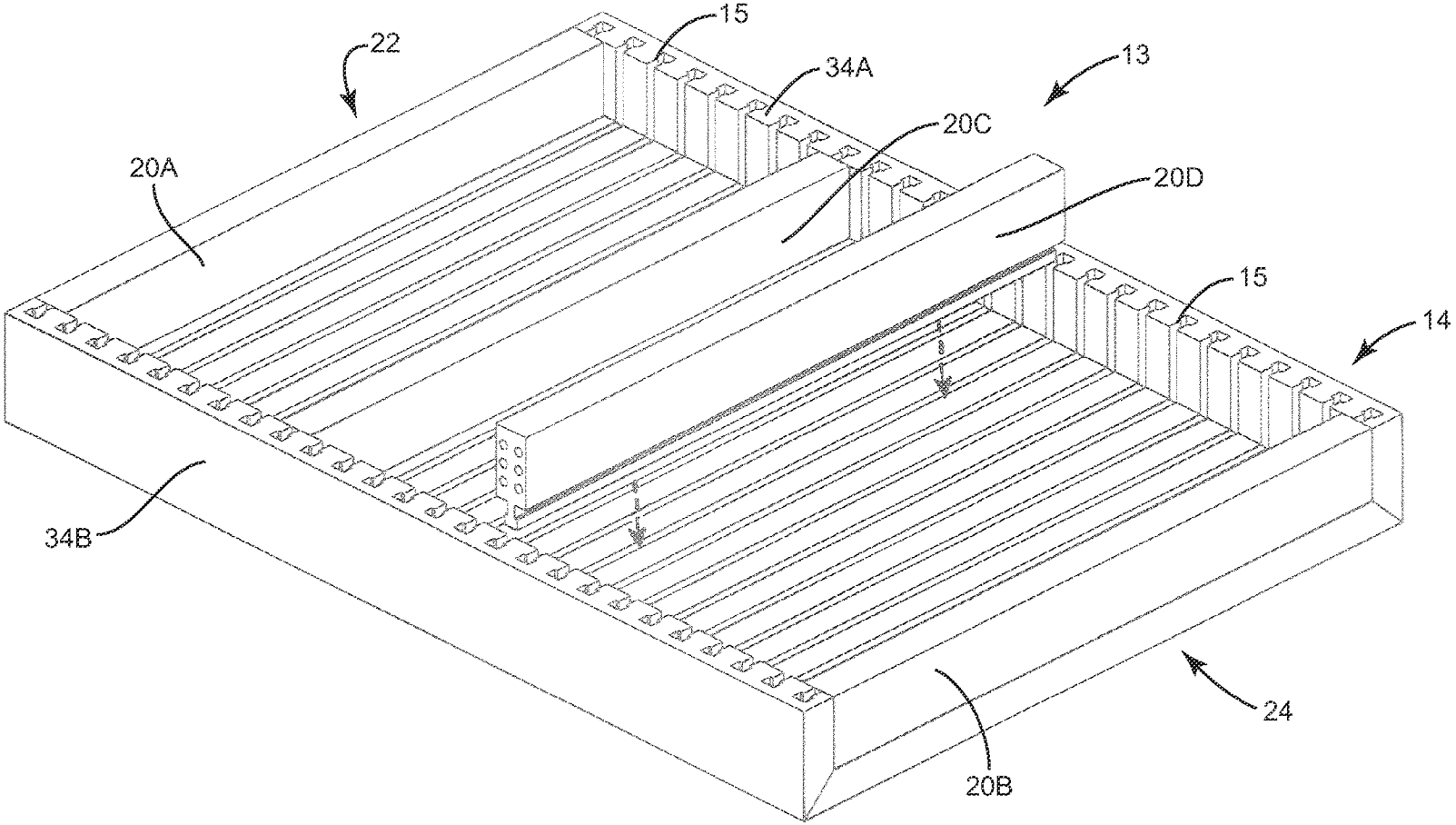
Figure 4C:
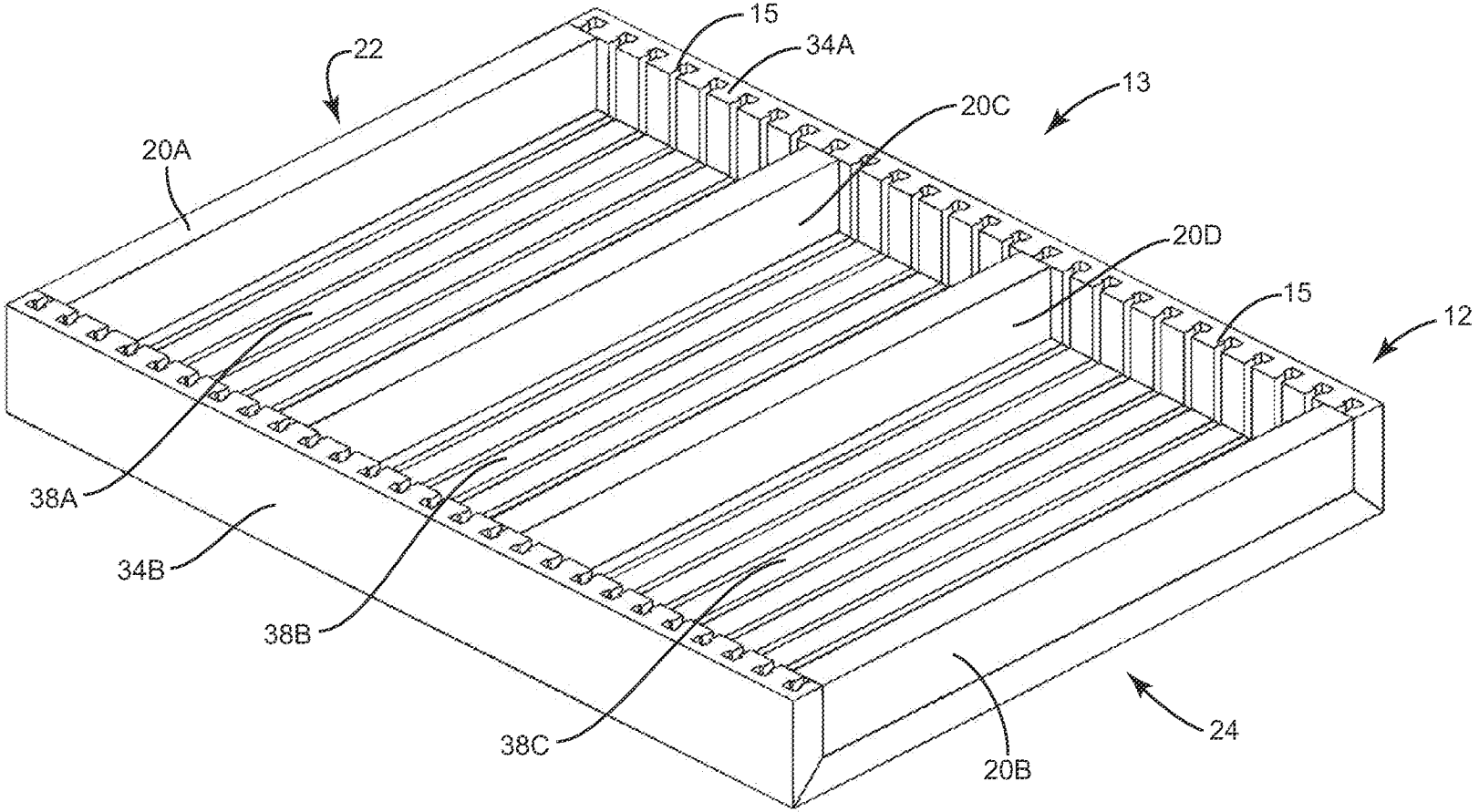
Figure 4D:
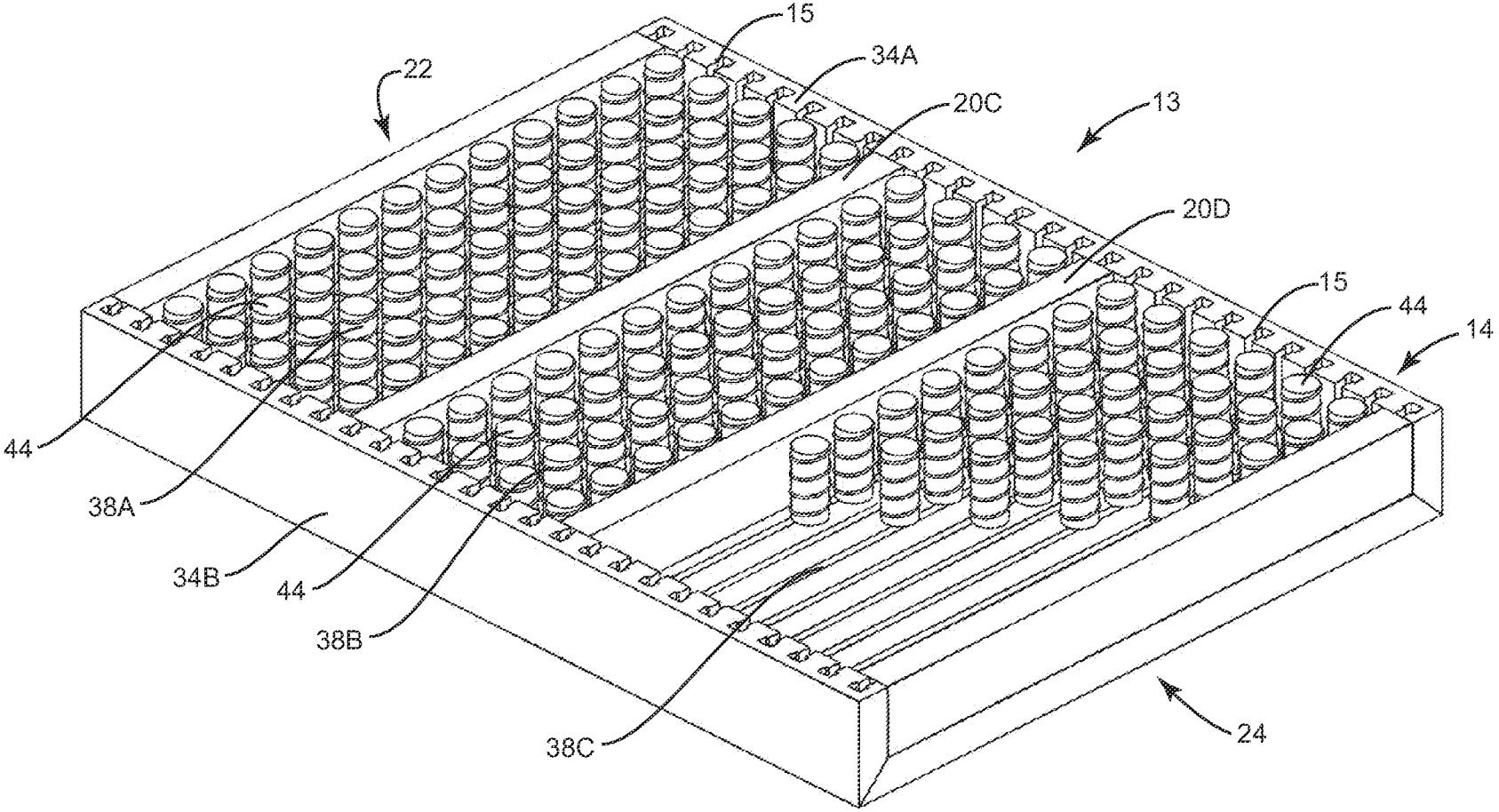
FIG. 4D illustrates the assembled encasement of FIG. 4C having pocketed coils disposed in an internal area within the encasement to provide an innerspring assembly.

FIG. 4B illustrates the encasement 13 with the perimeter area via attachment of the side-support members 20A, 20B and the flip-up side-support members 34A, 34B interlocked to provide the internal area 38. The support members 20A, 20B can be inserted when the perimeter area of the encasement 13 is formed. FIG. 4C illustrates two support members 20C, 20D engaged within elongated channels 15 between the head end 22 and the foot end 24. In this manner, the two support members 20C, 20D separate the internal area 38 into three internal area regions 38A-38C, as illustrated in FIG. 4C. FIG. 4D illustrates pocketed coils 46 as one example of a support structure that can disposed in one or more internal areas 38A-38C of the encasement 13. The pocketed coils 46 may provide a different firmness or support than the flip-up side-support members 34A, 34B, the side-support members 20A, 20B, and the support members 20C, 20D disposed inside the internal area 38. Alternatively, different types of support structures, including but not limited to the pocketed coils 46, the coil springs 36, and the core 40 can be disposed in different internal areas 38A-38C to provide composite support in the encasement 13.

Figure 5A:
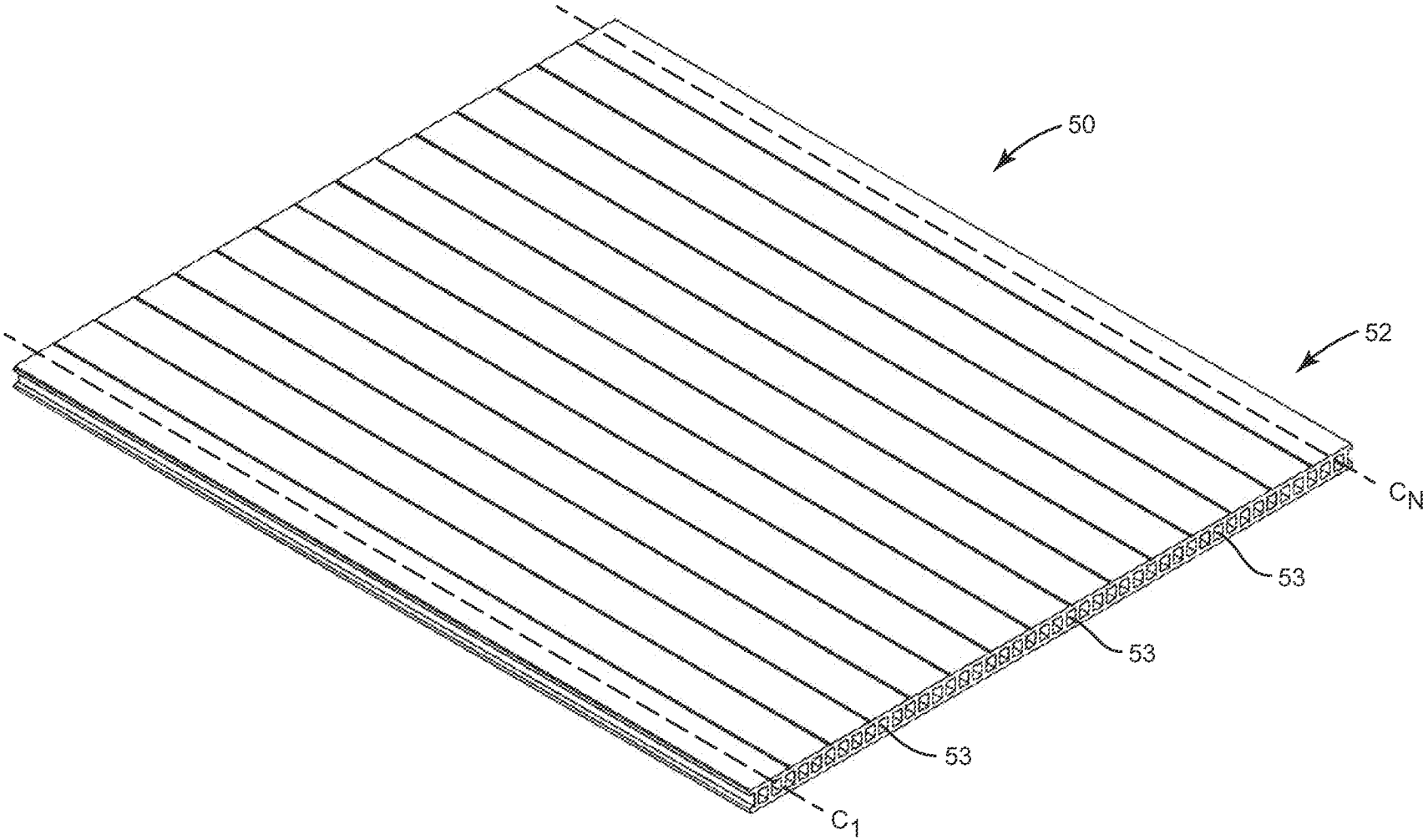
FIG. 5A is an exemplary foam base for an encasement.

FIGS. 5A-5D illustrate another embodiment of an encasement that may be provided. In this embodiment as illustrated in FIG. 5A, an encasement 50 is provided that is comprised of a base 52. In this embodiment, the encasement 50 is constructed from a one-piece base 52 as opposed to additional pieces, such as side-support members 20A, 20B illustrated in the previous figures, being required to provide an assembled encasement. The base 52 may be manufactured from extruded polymer foam. As examples of the wide variety of alternate compositions that can be employed and effectively used, the base 52 may be formed from one or more materials selected from the group consisting of polystyrenes, polyefins, polyethylenes, polybutanes, polybutylenes, polyurethanes, polyesters, ethylene acrylic copolymers, ethylene-vinyl-acetate copolymers, ethylene-methyl acrylate copolymers, ethylene-butyl-acrylate copolymers, ionomers, polypropylenes, copolymers of polypropylene, and the like. Such polymers may be foamed to provide the base 52 including either open-cell foam, closed-cell foam, or both open and closed-cell foam. An example of an extruded polymer base and method of manufacture of same are disclosed in U.S. Pat. No. 6,537,405 entitled "Spiral Formed Products and Method of Manufacture," and U.S. Pat. No. 6,306,235 entitled "Spiral Formed Products and Method of Manufacture," both of which are incorporated herein by reference in their entireties. The density of the base 52 may be any density desired.

Figure 5B:
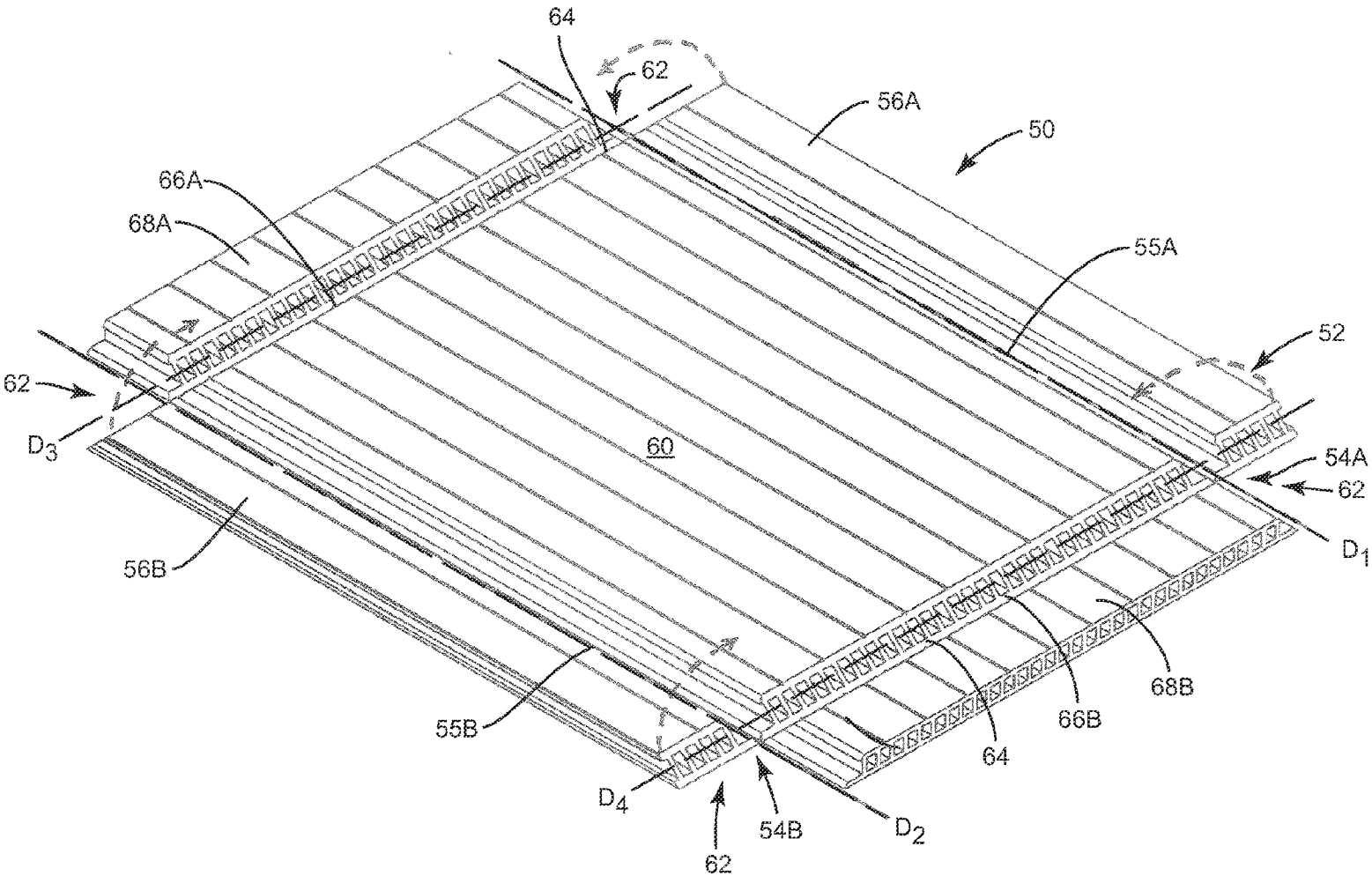
FIG. 5B is the base of FIG. 5A with contour cuts and corners removed to create living hinges alongside axes of the base to create flip-up side-support members disposed around the perimeter of the base.
Figure 5C:
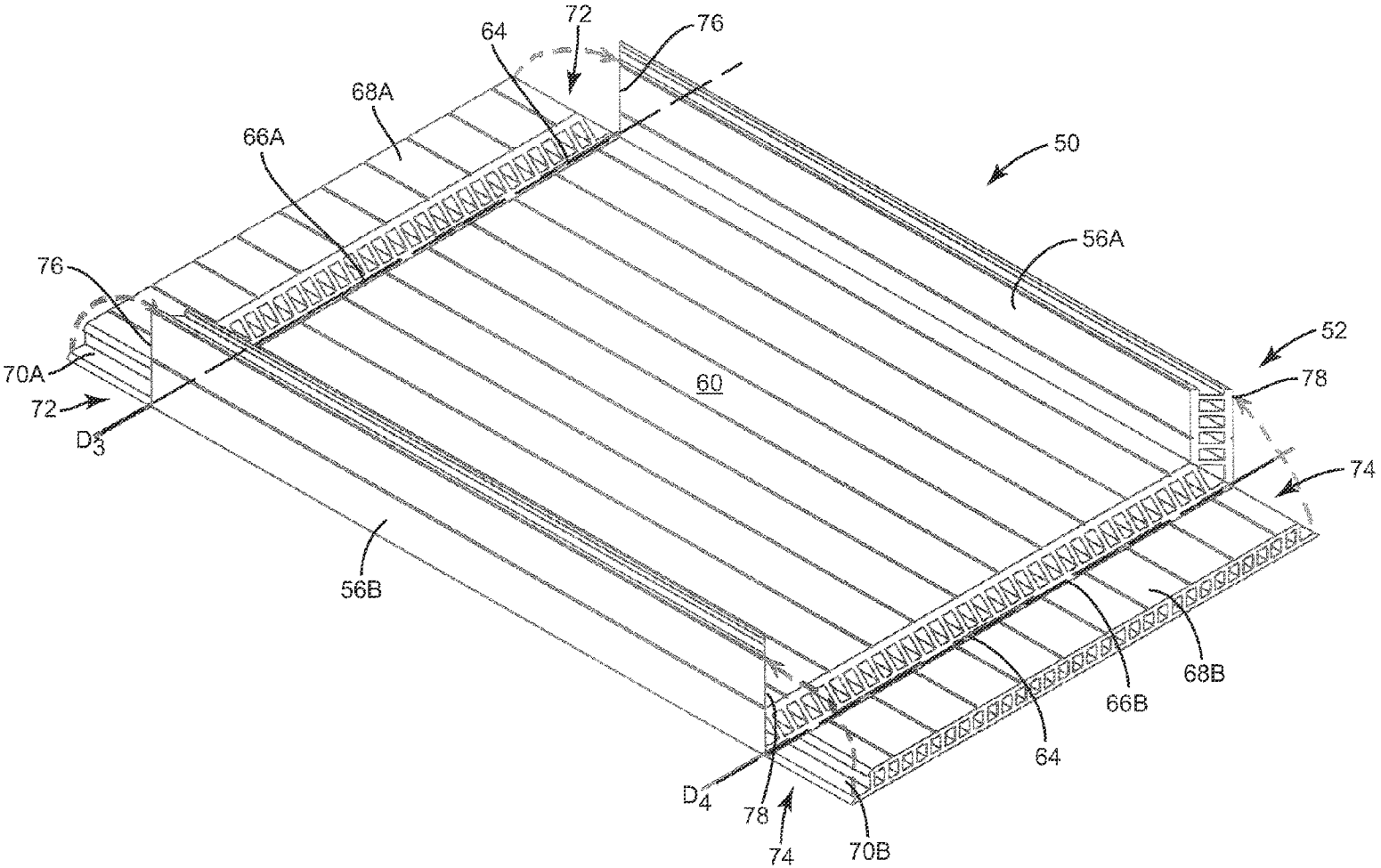
FIG. 5C is the base of FIG. 5B with flip-up side-support members disposed on sides of the base flipped-up or set about the base to create side support.
Figure 5D:
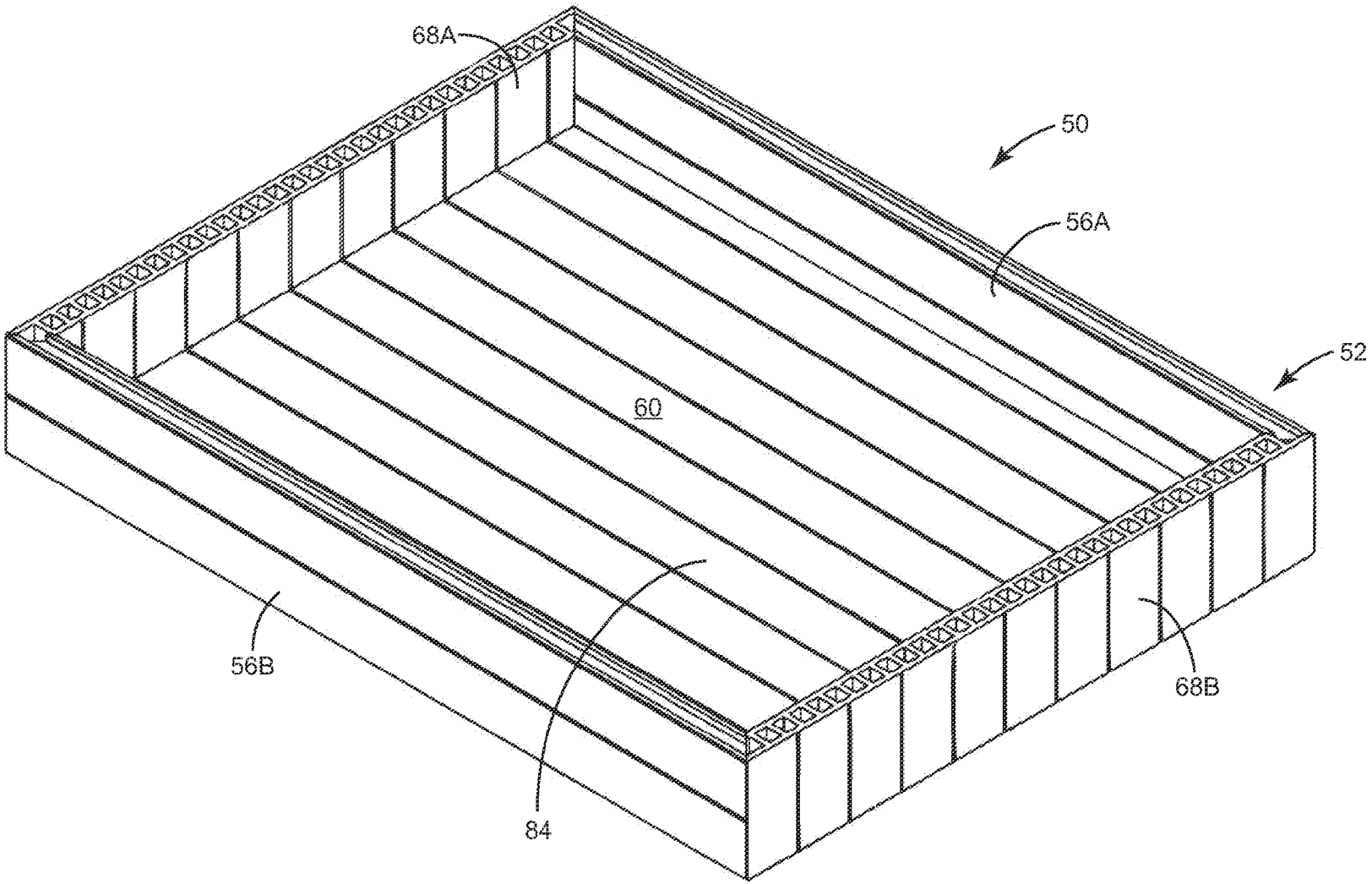
FIG. 5D is an assembled one-piece encasement formed by the flip-up side-support members disposed on the head end and foot end of the base additionally flipped-up or set about the base and attached on ends to the flipped-up or set side-support members in FIG. 5C to provide perimeter support around an internal area within the encasement.

The base 52 may optionally include one or more extruded channels 53 disposed along longitudinal axes $C_1$-$C_N$ to reduce material and thus reduce costs and/or to provide spring-like action in the base 52. FIGS. 5B-5D illustrate how the encasement 50 is provided from the base 52 in FIG. 5A in this embodiment. As illustrated in FIG. 5B, two sets of contour cuts 54A, 54B are disposed along longitudinal axes $D_1$, $D_2$ in the base 52 to provide living hinges 55A, 55B. In this manner, flip-up side-support members 56A, 56B are formed about the living hinges 55A, 55B similarly to the flip-up side-support members 34A, 34B provided in FIGS. 2A-2E. The flip-up side-support members 56A, 56B can be rotated approximately ninety degrees)(90°) towards an internal area 60 of the base 52 to provide two sides of perimeter support as part of constructing the encasement 50.

In this embodiment, instead of side-support members being disposed in elongated channels in the base 52 to provide two side-supports perpendicular to the flip-up side-supports 56A, 56B as provided in FIGS. 2A-2E, corners 62 are cut out from the base 52. Turning back to FIG. 5B, the corners 62 are cut out and contour cuts 64 are also disposed along axes $D_3$, $D_4$ in the base 52. These contour cuts 64 provide living hinges 66A, 66B in the base 52 to create additional flip-up side-support members 68A, 68B. In this manner, the flip-up side-support members 68A, 68B can also be flipped up or set about the base 52 to provide an enclosed encasement 50, as illustrated in FIGS. 5C and 5D. Additional contour cuts 70A, 70B, are disposed in each of the flip-up side-support members 68A, 68B so that ends 72, 74 of the flip-up side-support members 68A, 68B can abut end portions 76, 78 of the flip-up side-support members 56A, 56B to provide an assembled encasement 50, as illustrated in FIG. 5D. The flip-up side-support members 56A, 56B, 68A, 68B can be interlocked together according to any of the methods previously described to form an internal area 84 in the encasement 50, as illustrated in FIG. 5D, to provide perimeter support, including edge or side support. Any of the aforementioned surface support structures can be disposed in the internal area 84 to provide an assembly, which may be for a mattress or other bedding or cushioning application.

Figure 6A:
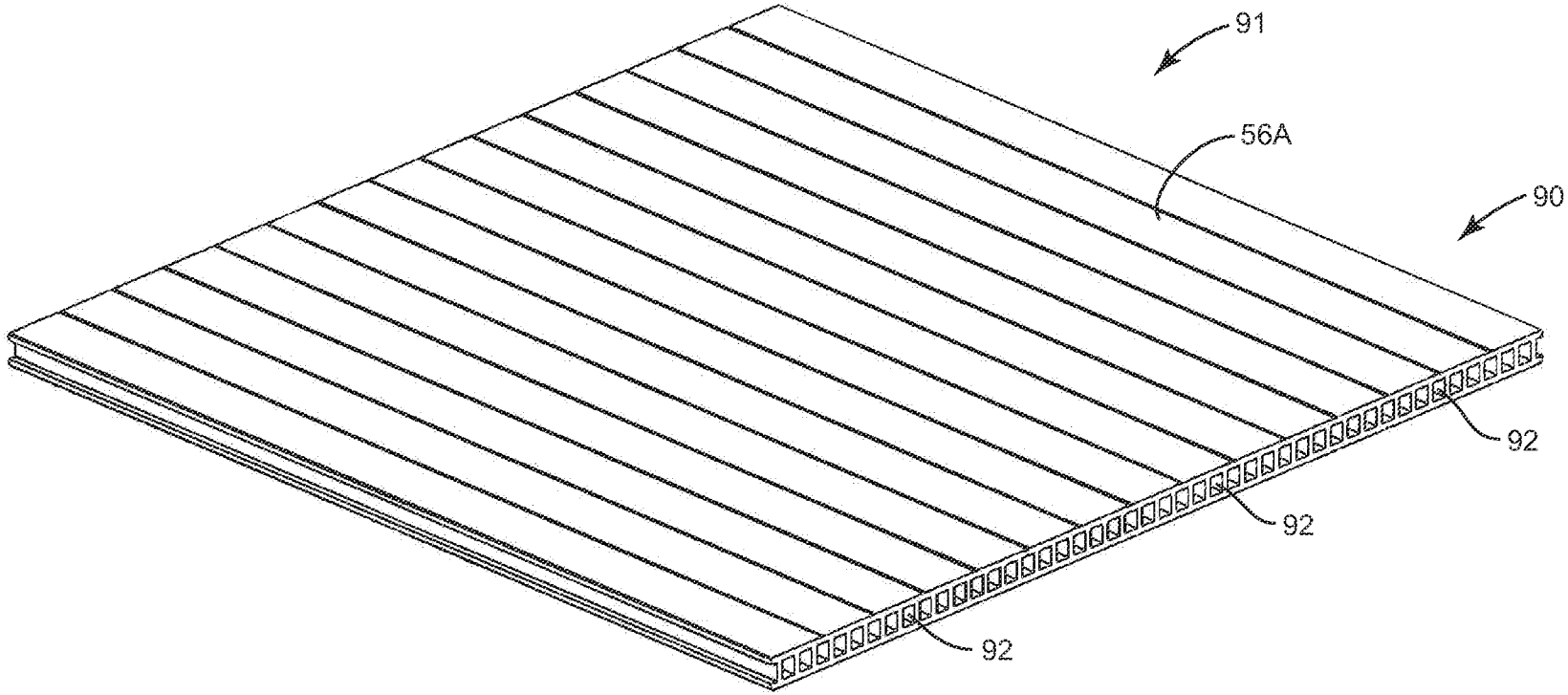
FIG. 6A is an exemplary foam base for an encasement.
Figure 6B:
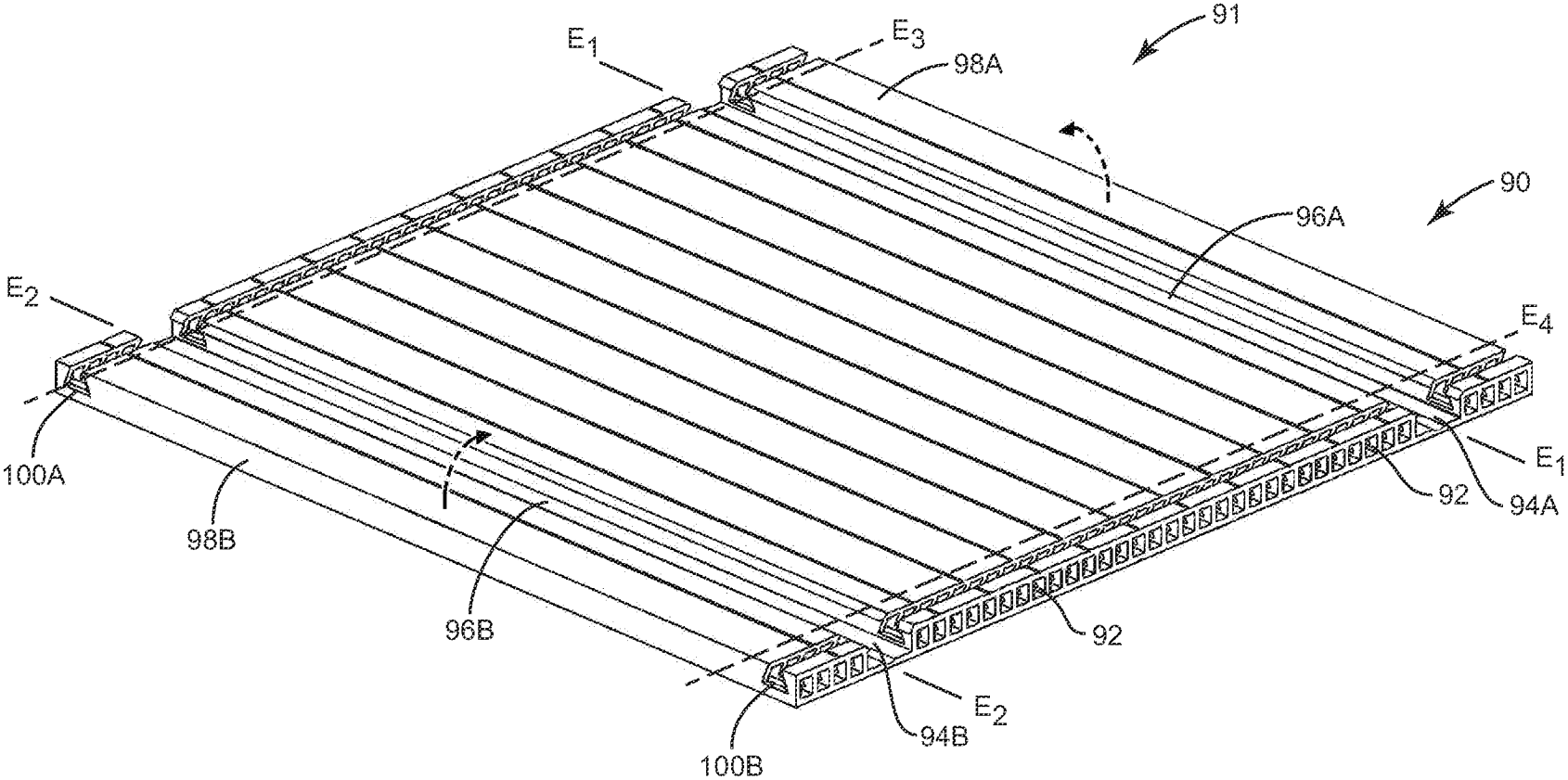
FIG. 6B is the base of FIG. 6A with elongated dovetail channels disposed on a head end and a foot end of the base configured to support side-support members and contour cuts in the base on sides to create living hinges alongside axes of the base to create flip-up side-support members disposed around the perimeter of the base.
Figure 6C:
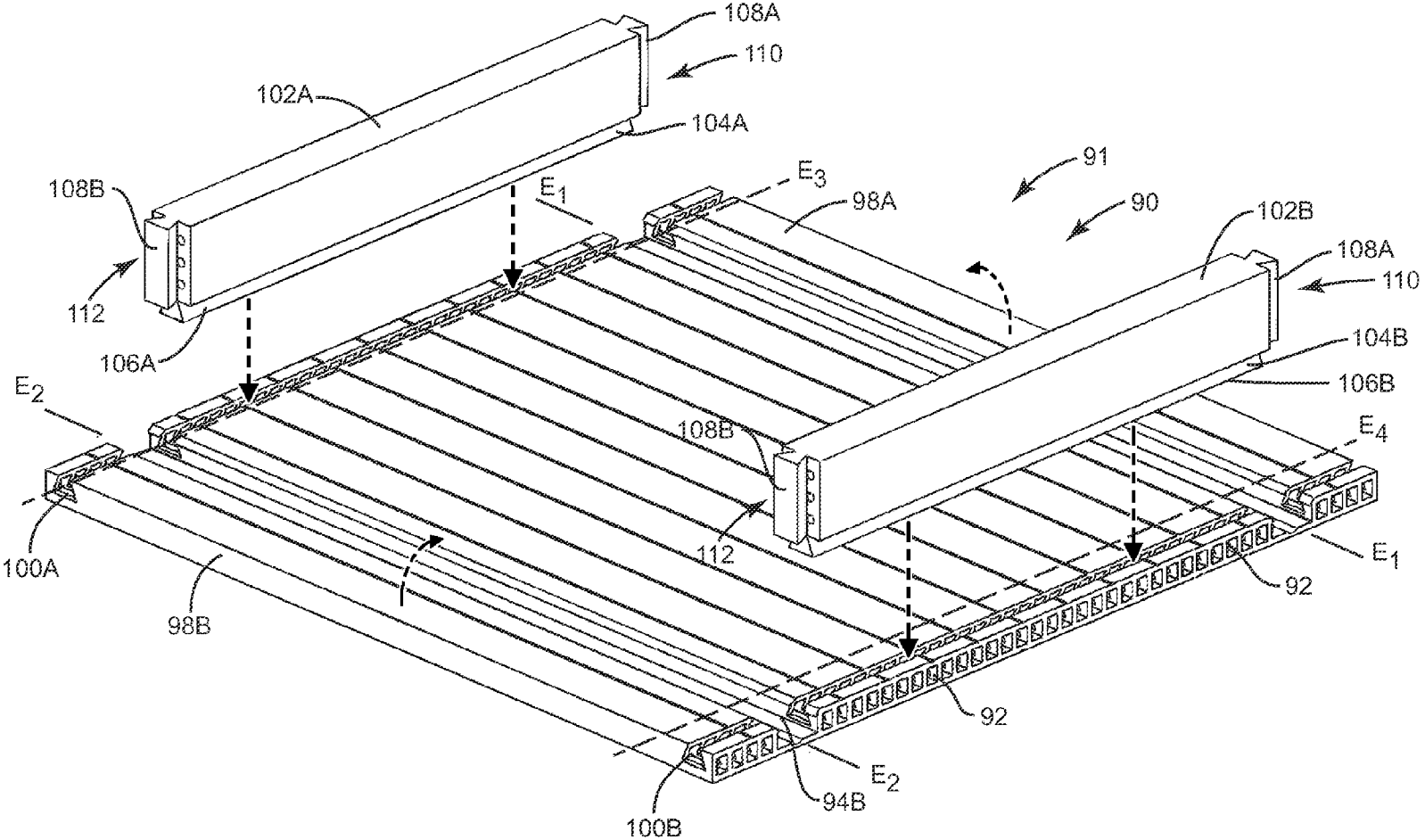
FIG. 6C is the base of FIG. 6B with flip-up side-support members shown before engagement with the elongated dovetail channels in the base.
Figure 6D:
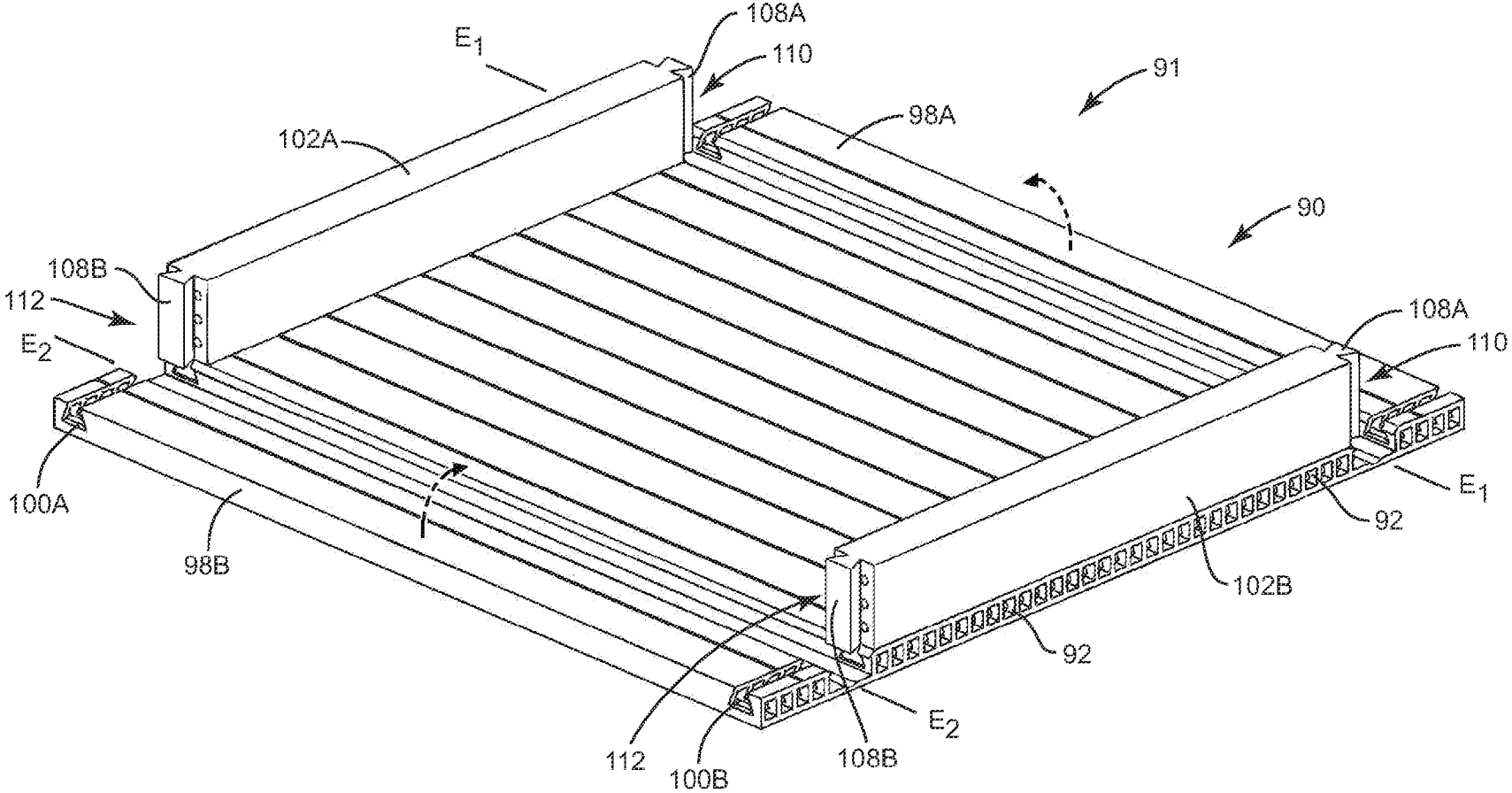
FIG. 6D is the base of FIG. 6B with the flip-up side-support members of FIG. 6C engaged with the elongated dovetail channels in the base to provide side support on the head end and the foot end of the base.
Figure 6E:
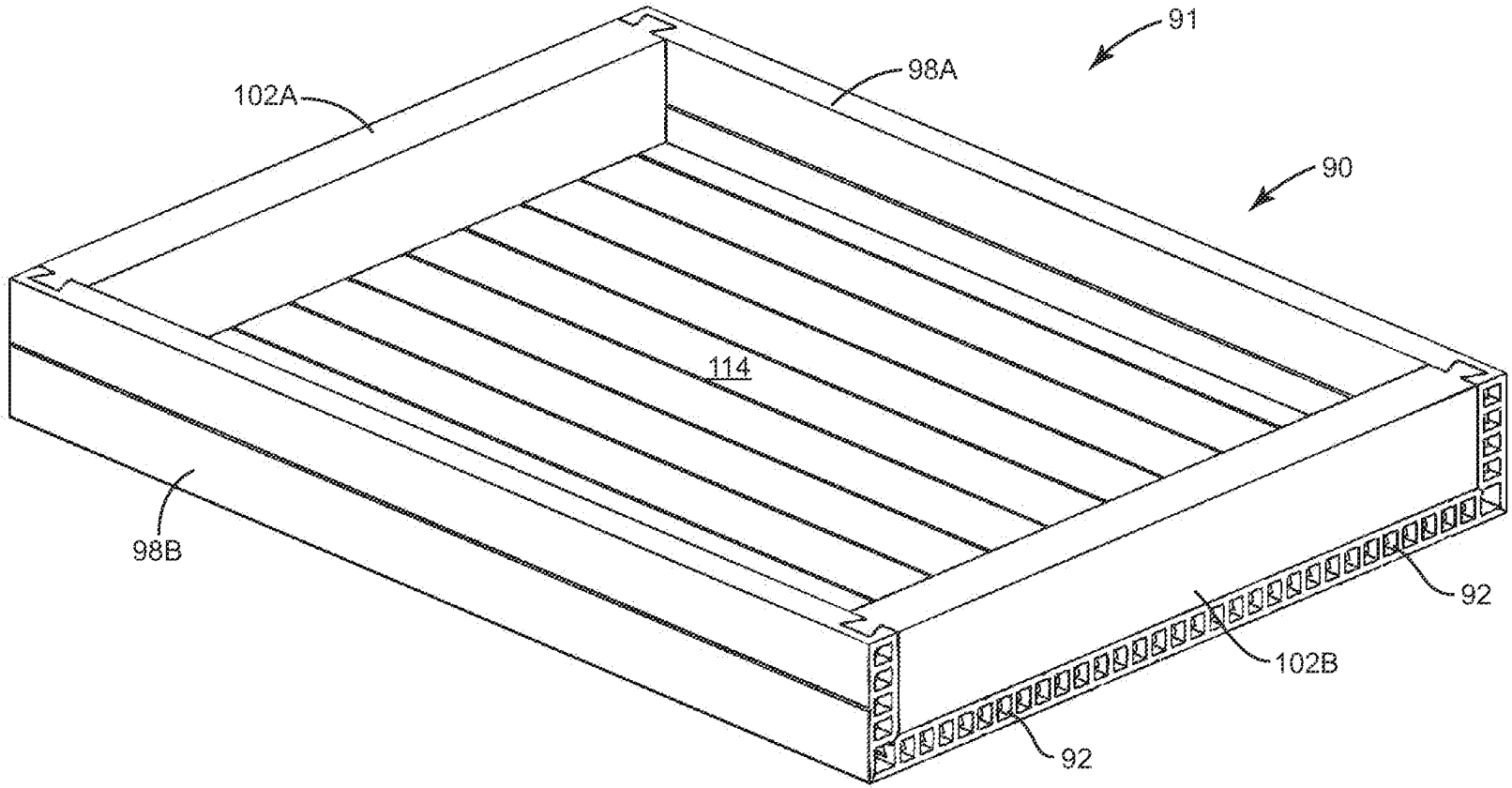
FIG. 6E is an assembled encasement formed by the flip-up side-support members flipped-up or set about the living hinges in the base and attached to ends of the side-support members engaged with the elongated dovetail channels.

FIG. 6A is another exemplary foam base 90 that can be used to provide an encasement according to another embodiment. The base 90 can be the same base 52 as provided in FIG. 5A. The base 90 can include extruded channels 92 like the channels 53 extruded from the base 52 of FIG. 5A. As illustrated in FIG. 6B, an alternative flip-up side-support system is provided to allow formation of an encasement 91. In this embodiment, cuts 94A, 94B are disposed along longitudinal axes $E_1$, $E_2$ to form living hinges 96A, 96B in the base 90 to create flip-up side-support members 98A, 98B. Elongated dovetail channels 100A, 100B are also cut into the base 90 along longitudinal axes $E_3$, $E_4$ to provide support for attachment of side-support members 102A, 102B, as illustrated FIGS. 6C and 6D. The side-support members 102A, 102B include dovetail rails 104A, 104B that include a complimentary male dovetail portions 106A, 106B configured to engage with the elongated dovetail channels 100A, 100B to secure the side-support members 102A, 102B to the base to form part of the perimeter area of the encasement 91 similar to previous embodiments and illustrated in FIG. 6D. The side-support members 102A, 102B also each include dovetail rails 108A, 108B on each end 110, 112 of the side-support members 102A, 102B to engage with the elongated dovetail channels 100A, 100B disposed in the flip-up side-support members 98A, 98B when flipped-up or set about the base 90, as illustrated in FIG. 6E to provide an assembled encasement 91 having an internal area 114. Any type of support structure, including but not limited to the coil springs 36, the core 40, and the pocketed coils 46 may be disposed in the internal area 114 to provide an assembly.

Those skilled in the art will recognize improvements and modifications to the embodiments disclosed herein. Many modifications and other embodiments of the invention set forth herein will come to mind to one skilled in the art to which the invention pertains having the benefit of the teachings presented in the foregoing descriptions and the associated drawings. These modifications include, but are not limited to the type of innerspring or core, its materials or compositions, including but not limited to whether exclusively thermoset or thermoplastic type materials or a composite of both, whether the innerspring contains spring coils, pocketed coils, or any other type of coil or spring, the from and shape of the perimeter side members, the heights and other dimensions of any of the aforementioned components, etc. All such improvements and modifications are considered within the scope of the concepts disclosed herein.

Further, it is to be understood that the embodiments are not to be limited to the specific embodiments disclosed and that modifications and other embodiments are intended to be included within the scope of the embodiments. It is intended that the embodiments cover the modifications and variations of this invention provided they come within the scope of the embodiments. Although specific terms are employed herein, they are used in a generic and descriptive sense only and not for purposes of limitation.

What is claimed is:

1. An assembly for bedding or seating, comprising:

a base having one or more elongated channels disposed therein having a first geometry, the base further comprises at least one hinge disposed along a longitudinal axis of the base to form at least one flip-up support member of the base to form at least a portion of an encasement when the at least one flip-up support member is rotated upward about the hinge, the one or more elongated channels being continuous when the flip up support member is rotated up; and one or more elongated support members each comprising a first side and a second side, the first side containing a first rail having a second geometry complimentary to the first geometry, the second side disposed orthogonal or substantially orthogonal to the first side, and the second side including a second rail, wherein each of the first rail of the one or more elongated support members is interlocked with a respective elongated channel of the one or more elongated channels of the base such that the one or more elongated support members are attached to the base and extend from the base to provide at least a portion of the encasement, and wherein each of the second rail of the one or more elongated support members is interlocked with the respective elongated channel of the one or more elongated channels disposed in the at least one flip-up support member to provide at least a portion of the encasement.

2. The assembly of claim 1, wherein the base is disposed in a first plane and the one or more elongated support members extend into a second plane perpendicular or substantially perpendicular to the first plane.

3. The assembly of claim 1, wherein the one or more elongated support members are formed out of at least one of a polymer, a polymer foam, latex, a viscoelastic, and a viscoelastic foam.

4. The assembly of claim 1, wherein the one or more elongated support members are formed of at least one polymer selected from the group consisting of a polystyrene, a polyolefin, a polyethylene, a polybutane, a polybutylene, a polyurethane, a polyester, an ethylene acrylic copolymer, an ethylene-vinyl-acetate copolymer, an ethylene-methyl acrylate copolymer, an ethylene-butyl-acrylate copolymer, an ionomer, a polypropylene, and copolymers of polypropylene.

5. The assembly of claim 1, further comprising at least one interior area formed in the base by the one or more elongated support members interlocked with the one or more elongated channels.

6. The assembly of claim 5, further comprising at least one of a coil, a pocketed coil, foam, a thermoplastic material, and a thermoset material disposed in the at least one interior area.

7. The assembly of claim 1, wherein the rails are shaped in a form comprised from the group consisting of a T-shape, a male T-shape, a female T-shape, and a dove-tail shape.

8. The assembly of claim 1, where at least one of the one or more elongated support members is attached to the base on a perimeter of the base.

9. The assembly of claim 1, further comprising an adhesive disposed in either the one or more elongated channels, the one or more rails, or both, to further secure the one or more elongated support members to the base.

10. The assembly of claim 1, wherein a plurality of elongated support members are interlocked with a plurality of elongated channels to form at least two interior areas in the base.

11. The assembly of claim 1, wherein the at least one flip-up support member is comprised of at least one flip-up section disposed in the base and flipped up about the base in a second plane perpendicular or substantially perpendicular to a first plane to form at least the portion of the encasement.

12. The assembly of claim 1, wherein the at least one flip-up support member is formed by at least one hinge disposed in the base.

13. The assembly of claim 12, wherein the at least one hinge is comprised of at least one living hinge.

14. The assembly of claim 12, wherein each of the at least one hinge is formed by two opposing contour cuts in the base made at approximately a forty-five (45) degree angle with respect to a longitudinal axis of the base to create two opposing faces configured to be brought together to form the at least one flip-up section.

15. The assembly of claim 1, wherein an end of the at least one flip-up support member is orthogonally or substantially orthogonally disposed adjacent an end of the one or more elongated support members to form at least one corner of the encasement.

16. The assembly of claim 15, further comprising an adhesive disposed between the end of the at least one flip-up support member and the end of the one or more elongated support members to secure the at least one corner of the encasement.

17. The assembly of claim 1, wherein each of the one or more elongated channels extends across the base.

18. The assembly of claim 1, wherein each of the one or more elongated channels spans across the at least one hinge.

19. A method of forming at least a portion of an encasement for an assembly for bedding or seating, comprising:

providing a base including one or more elongated channels disposed therein having a first geometry;

forming at least one hinge along a portion of a longitudinal axis of the base to form at least one flip-up support member in the base, the one or more elongated channels being continuous when the flip up support member is rotated up;

providing one or more elongated support members each comprising a first side and a second side, the first side containing a first rail having a second geometry complimentary to the first geometry, the second side disposed orthogonal or substantially orthogonal to the first side, and the second side including a second rail; and interlocking each of the first rail of the one or more elongated support members with a respective elongated channel of the one or more elongated channels such that the one or more elongated support members are attached to the base and extend from the base to provide at least a portion of the encasement; and interlocking each of the second rail of the one or more elongated support members with the respective elongated channel of the one or more elongated disposed in the at least one flip-up support member to provide at least a portion of the encasement.

20. The method of claim 19, further comprising either extruding or cutting the first rail into the one or more elongated support members.

21. The method of claim 19, further comprising either extruding or cutting the one or more elongated channels into the base.

22. The method of claim 19, further comprising disposing the first rail of the one or more elongated support members in a first plane into at least one of the one or more elongated channels in a second plane perpendicular or substantially perpendicular to the first plane.

23. The method of claim 19, further comprising forming at least one interior area in the base by attaching the one or more elongated support members interlocked with the one or more elongated channels.

24. The method of claim 19, further comprising disposing the first rail of the one or more elongated support members into at least one of the one or more elongated channels disposed on a perimeter of the base.

25. The method of claim 19, further comprising disposing an adhesive in either the one or more elongated channels, the one or more first rails, or both, to further secure the one or more elongated support members to the base.

26. The method of claim 19, comprising disposing the rail of the one or more elongated support members into at least one of the one or more elongated channels to form at least two interior areas in the base.

27. The method of claim 19, further comprising flipping up the at least one flip-up support member disposed in the base about the base in a second plane perpendicular or substantially perpendicular to a first plane.

28. The method of claim 27, wherein flipping up the at least one flip-up support member comprises bringing together two opposing contour cuts in the base made at approximately a forty-five (45) degree angle with respect to a longitudinal axis of the base to create two opposing faces configured to be brought together to form the at least one flip-up section.

29. The method of claim 19, further comprising disposing an end of the at least one flip-up support member orthogonally or substantially orthogonally adjacent to an end of the one or more elongated support members to form at least one corner of the encasement.

30. The method of claim 29, further comprising disposing an adhesive between the end of the at least one flip-up support member and the end of the one or more elongated support members to secure the at least one corner of the encasement.

31. An assembly for bedding or seating, comprising:

a base extending longitudinally from a first end to a second end opposite the first end, the base comprising a first surface forming at least one channel, each of the at least one channel extending from the first end to the second end, the base comprising at least one hinge with a respective at least one pivot angled to the at least one channel; and at least one elongated support member comprising a plurality of rails configured to interlock with portions of the at least one channel, the portions disposed on both sides of each of the at least one hinge, wherein the hinge is configured to bend to allow the base to enclose an internal area from at least two sides, such that the at least one elongated channel is continuous when the hinge is bent to allow the base to enclose the internal area.

* * * * *